US012571292B2

(12) United States Patent
Vahsholtz et al.

(10) Patent No.: US 12,571,292 B2
(45) Date of Patent: Mar. 10, 2026

(54) EXHAUST HEAT RECOVERY FOR A MOBILE POWER GENERATION SYSTEM

(71) Applicant: Typhon Technology Solutions (U.S.), LLC, The Woodlands, TX (US)

(72) Inventors: Matthew James Vahsholtz, The Woodlands, TX (US); Mika Hirvonen, The Woodlands, TX (US); Steve Rodriguez, The Woodlands, TX (US); Brett Vann, The Woodlands, TX (US)

(73) Assignee: Typhon Technology Solutions (U.S.), LLC, The Woodlands, TX (US)

( * ) Notice: Subject to any disclaimer, the term of this patent is extended or adjusted under 35 U.S.C. 154(b) by 237 days.

(21) Appl. No.: 18/218,414

(22) Filed: Jul. 5, 2023

(65) Prior Publication Data

US 2025/0012218 A1 Jan. 9, 2025

(51) Int. Cl.
*E21B 43/26* (2006.01)

(52) U.S. Cl.
CPC ..... *E21B 43/2607* (2020.05)

(58) Field of Classification Search
CPC ..... F28D 21/001; F02C 6/18; F28F 27/00; E21B 43/26; F01D 15/10; F05D 2220/76
USPC ..... 165/47, 292
See application file for complete search history.

(56) References Cited

U.S. PATENT DOCUMENTS

| | | | |
|---|---|---|---|
| 2,554,228 | A | 5/1951 | Walker et al. |
| 4,473,536 | A | 9/1984 | Carberg et al. |
| 5,247,991 | A | 9/1993 | Polcer |
| 5,517,822 | A | 5/1996 | Haws et al. |
| 5,778,657 | A | 7/1998 | Ohtomo et al. |
| 5,938,975 | A | 8/1999 | Ennis et al. |
| 6,668,537 | B1 | 12/2003 | Hays |
| 8,171,993 | B2 | 5/2012 | Hefley |
| 9,121,257 | B2 | 9/2015 | Coli et al. |
| 9,140,110 | B2 | 9/2015 | Coli et al. |
| 9,435,175 | B2 | 9/2016 | Chong et al. |
| 9,475,020 | B2 | 10/2016 | Coli et al. |
| 9,475,021 | B2 | 10/2016 | Coli et al. |

(Continued)

FOREIGN PATENT DOCUMENTS

| | | |
|---|---|---|
| AR | 087298 A1 | 3/2014 |
| AR | 092923 A1 | 5/2015 |

(Continued)

OTHER PUBLICATIONS

PCT Invitation to Pay Additional Fees, PCT Application No. PCT/US2023/26936, Sep. 14, 2023, 2 pages.

(Continued)

*Primary Examiner* — Claire E Rojohn, III
(74) *Attorney, Agent, or Firm* — Fenwick & West LLP

(57) ABSTRACT

An exhaust air connection receives exhaust air from a separate power generation system. A heat transfer assembly transfers thermal energy from the exhaust air to a source fluid to generate a heated source fluid. A valve regulates a flow of the exhaust air from the exhaust air connection to a heat recovery flow path disposed with the heat transfer assembly and to a bypass flow path bypassing the heat transfer assembly. A control system operates the valve to regulate the flow of the exhaust air. An exhaust releases to atmosphere the exhaust air from at least one of the heat recovery flow path and the bypass flow path.

20 Claims, 11 Drawing Sheets

(56) References Cited

U.S. PATENT DOCUMENTS

| | | | | |
|---|---|---|---|---|
| 9,534,473 | B2 | 1/2017 | Morris et al. | |
| 9,611,728 | B2 | 4/2017 | Oehring | |
| 9,995,218 | B2 | 6/2018 | Oehring et al. | |
| 10,107,084 | B2 | 10/2018 | Coli et al. | |
| 10,107,085 | B2 | 10/2018 | Coli et al. | |
| 10,221,668 | B2 | 3/2019 | Coli et al. | |
| 10,227,855 | B2 | 3/2019 | Coli et al. | |
| 10,502,042 | B2 | 12/2019 | Coli et al. | |
| 10,648,312 | B2 | 5/2020 | Coli et al. | |
| 10,689,961 | B2 | 6/2020 | Coli et al. | |
| 10,718,194 | B2 | 7/2020 | Coli et al. | |
| 10,724,353 | B2 | 7/2020 | Coli et al. | |
| 10,774,630 | B2 | 9/2020 | Coli et al. | |
| 10,837,270 | B2 | 11/2020 | Coli et al. | |
| 10,851,634 | B2 | 12/2020 | Coli et al. | |
| 10,876,386 | B2 | 12/2020 | Coli et al. | |
| 10,895,138 | B2 * | 1/2021 | Coli | B01F 35/3204 |
| 11,434,763 | B2 | 9/2022 | Morris et al. | |
| 11,512,632 | B2 | 11/2022 | Morris et al. | |
| 11,512,906 | B2 * | 11/2022 | Morris | F28F 27/00 |
| 11,725,582 | B1 * | 8/2023 | Morris | H02K 7/1823 60/39.092 |
| 11,927,087 | B2 * | 3/2024 | Bodishbaugh | F04B 15/02 |
| 2003/0057704 | A1 | 3/2003 | Baten et al. | |
| 2003/0079479 | A1 | 5/2003 | Kristich et al. | |
| 2006/0042259 | A1 | 3/2006 | Marushima et al. | |
| 2007/0256424 | A1 | 11/2007 | Briesch et al. | |
| 2011/0185702 | A1 | 8/2011 | Bilton et al. | |
| 2014/0039708 | A1 | 2/2014 | Curtis et al. | |
| 2014/0060774 | A1 | 3/2014 | Motakef et al. | |
| 2014/0096974 | A1 | 4/2014 | Coli et al. | |
| 2015/0068724 | A1 | 3/2015 | Coli et al. | |
| 2015/0083235 | A1 | 3/2015 | Larson | |
| 2015/0300145 | A1 | 10/2015 | Coli et al. | |
| 2015/0314255 | A1 | 11/2015 | Coli et al. | |
| 2016/0061061 | A1 | 3/2016 | Ekanayake et al. | |
| 2016/0102612 | A1 | 4/2016 | Kaufman | |
| 2016/0177675 | A1 | 6/2016 | Morris et al. | |
| 2016/0208593 | A1 | 7/2016 | Coli et al. | |
| 2016/0208594 | A1 | 7/2016 | Coli et al. | |
| 2016/0288278 | A1 | 10/2016 | Cavanaugh et al. | |
| 2016/0326855 | A1 | 11/2016 | Coli et al. | |
| 2016/0369609 | A1 | 12/2016 | Morris et al. | |
| 2017/0036178 | A1 | 2/2017 | Coli et al. | |
| 2017/0037718 | A1 | 2/2017 | Coli et al. | |
| 2017/0104389 | A1 | 4/2017 | Morris et al. | |
| 2017/0259227 | A1 | 9/2017 | Morris et al. | |
| 2018/0363434 | A1 | 12/2018 | Coli et al. | |
| 2018/0363435 | A1 | 12/2018 | Coli et al. | |
| 2018/0363436 | A1 | 12/2018 | Coli et al. | |
| 2018/0363437 | A1 | 12/2018 | Coli et al. | |
| 2018/0363438 | A1 | 12/2018 | Coli et al. | |
| 2019/0055827 | A1 | 2/2019 | Coli et al. | |
| 2019/0112908 | A1 | 4/2019 | Coli et al. | |
| 2019/0271218 | A1 | 9/2019 | Coli et al. | |
| 2019/0277125 | A1 | 9/2019 | Coli et al. | |
| 2019/0277126 | A1 | 9/2019 | Coli et al. | |
| 2019/0277127 | A1 | 9/2019 | Coli et al. | |
| 2019/0277128 | A1 | 9/2019 | Coli et al. | |
| 2020/0318467 | A1 | 10/2020 | Coli et al. | |
| 2020/0347710 | A1 | 11/2020 | Coli et al. | |
| 2020/0347711 | A1 | 11/2020 | Coli et al. | |
| 2021/0025324 | A1 * | 1/2021 | Morris | H02K 9/26 |
| 2021/0215440 | A1 * | 7/2021 | Morris | F02C 6/18 |
| 2025/0012218 | A1 * | 1/2025 | Vahsholtz | F02C 7/08 |

FOREIGN PATENT DOCUMENTS

| | | | |
|---|---|---|---|
| AR | 104823 | A2 | 8/2017 |
| AR | 104824 | A2 | 8/2017 |
| AR | 104825 | A2 | 8/2017 |
| AR | 104826 | A2 | 8/2017 |
| CA | 2955706 | A1 | 10/2012 |
| CA | 2773843 | C | 1/2016 |
| CA | 2835904 | C | 2/2017 |
| CA | 2845347 | C | 6/2017 |
| CA | 2900387 | C | 9/2018 |
| EP | 2904200 | A1 | 8/2015 |
| EP | 2726705 | B1 | 8/2018 |
| EP | 3444430 | A1 | 2/2019 |
| EP | 3444431 | A1 | 2/2019 |
| EP | 3444432 | A1 | 2/2019 |
| EP | 3447239 | A1 | 2/2019 |
| EP | 3453827 | A2 | 3/2019 |
| EP | 3456915 | A1 | 3/2019 |
| MX | 358054 | B | 8/2018 |
| MX | 362628 | B | 1/2019 |
| MX | 365888 | B | 6/2019 |
| MX | 365889 | B | 6/2019 |
| MX | 366049 | B | 6/2019 |
| WO | WO 2014/053056 | A1 | 4/2014 |

OTHER PUBLICATIONS

PCT International Search Report and Written Opinion, PCT Application No. PCT/US2023/26936, Nov. 2, 2023, 10 pages.

Canadian Office Action of Canadian application No. 3087558 dated Aug. 31, 2020, 4 pages.

Firestream Water Heaters for Fracking, www.heatec.com, Oct. 18, 2017, 4 pages.

Frac Tank Heating, McAdaFluidsHeatingServices, mcadafluidsheating.com/frac-tank-heating, Oct. 18, 2017, 2 pages.

Frac Water Heater, www.alliedoilfield.com, Oct. 18, 2017, 3 pages.

Kraken Tri-Fuel Superheater Technology, Aggreko, Oct. 18, 2017, 2 pages.

PCT International Search Report and Written Opinion, PCT Application No. PCT/US2018/068103, May 7, 2019, 11 pages.

* cited by examiner

800

EXHAUST HEAT RECOVERY FOR A MOBILE POWER GENERATION SYSTEM

TECHNICAL FIELD

Embodiments of the invention generally relate to exhaust heat recovery, and more particularly to an exhaust heat recovery transport attached to a power generation transport and using the exhaust of the power generation transport for heat transfer.

BACKGROUND

Hydraulic fracturing has been commonly used by the oil and gas industry to stimulate production of hydrocarbon wells, such as oil and/or gas wells. Hydraulic fracturing, sometimes called "fracing" or "fracking," is the process of injecting fracturing fluid, which is typically a mixture of water, sand, and chemicals, into the subsurface to fracture the subsurface geological formations and release otherwise encapsulated hydrocarbon reserves. The fracturing fluid is typically pumped into a wellbore at a relatively high pressure sufficient to cause fissures within the underground geological formations. Specifically, once inside the wellbore, the pressurized fracturing fluid is pressure pumped down and then out into the subsurface geological formation to fracture the underground formation. A fluid mixture that may include water, various chemical additives, and proppants (e.g., sand, or ceramic materials) is pumped into the underground formation to fracture the underground formation and promote the extraction of the hydrocarbon reserves, such as oil and/or gas.

Implementing large-scale fracturing operations at well sites typically require extensive investment in equipment, labor, and fuel. For instance, a typical fracturing operation uses a variety of fracturing equipment, numerous personnel to operate and maintain the fracturing equipment, large amounts of fuel to power the fracturing operations, and large volumes of fracturing fluid. Moreover, a single frac fleet may include 20+ semi-trailer loads of equipment including power generation trailers, fracturing trailers, hydration and blender trailers, sand silos, chemical storage containers, iron, hoses, cabling, data van, etc. It is desirable to improve operation and efficiency of the fracturing operations.

SUMMARY

The following presents a simplified summary of the disclosed subject matter in order to provide a basic understanding of some embodiments of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In some embodiments, an exhaust heat recovery apparatus is provided which comprises: an exhaust air connection configured to receive exhaust air from a separate power generation system; a heat transfer assembly configured to transfer thermal energy from the exhaust air to a source fluid to generate a heated source fluid; a valve configured to regulate a flow of the exhaust air from the exhaust air connection to a heat recovery flow path disposed with the heat transfer assembly and to a bypass flow path bypassing the heat transfer assembly; a control system configured to operate the valve to regulate the flow of the exhaust air; and an exhaust configured to release to atmosphere the exhaust air from at least one of the heat recovery flow path and the bypass flow path.

In some embodiments, a system for heating source fluid is provided which comprises: a first transport including a power generation system; and a second transport. The second transport includes: a base frame; an exhaust air connection mounted to the base frame and configured to receive exhaust air from the power generation system; a heat transfer assembly mounted to the base frame and configured to transfer thermal energy from the exhaust air to a source fluid to generate a heated source fluid; a control system configured to operate a valve to regulate a flow of the exhaust air from the exhaust air connection to a heat recovery flow path disposed with the heat transfer assembly and to a bypass flow path bypassing the heat transfer assembly; and an exhaust mounted to the base frame and configured to release to atmosphere the exhaust air from at least one of the heat recovery flow path and the bypass flow path.

In some embodiments, a method for heating source fluid is provided which comprises a plurality of steps. The steps include a step of receiving, at an exhaust air connection, a flow of exhaust air from a power generation system mounted on a separate power generation transport; and a step of transferring, in a heat transfer assembly, thermal energy from the received exhaust air to a source fluid to generate a heated source fluid. The steps further include a step of operating a valve to regulate the flow of the exhaust air from the exhaust air connection to a heat recovery flow path disposed with the heat transfer assembly and to a bypass flow path bypassing the heat transfer assembly; and maintaining a temperature of the heated source fluid within predetermined parameters by operating the valve. Still further, the steps include a step of releasing to atmosphere, via an exhaust, the exhaust air from at least one of the heat recovery flow path and the bypass flow path; and discharging the heated source fluid from the heat transfer assembly.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

Figure 1:
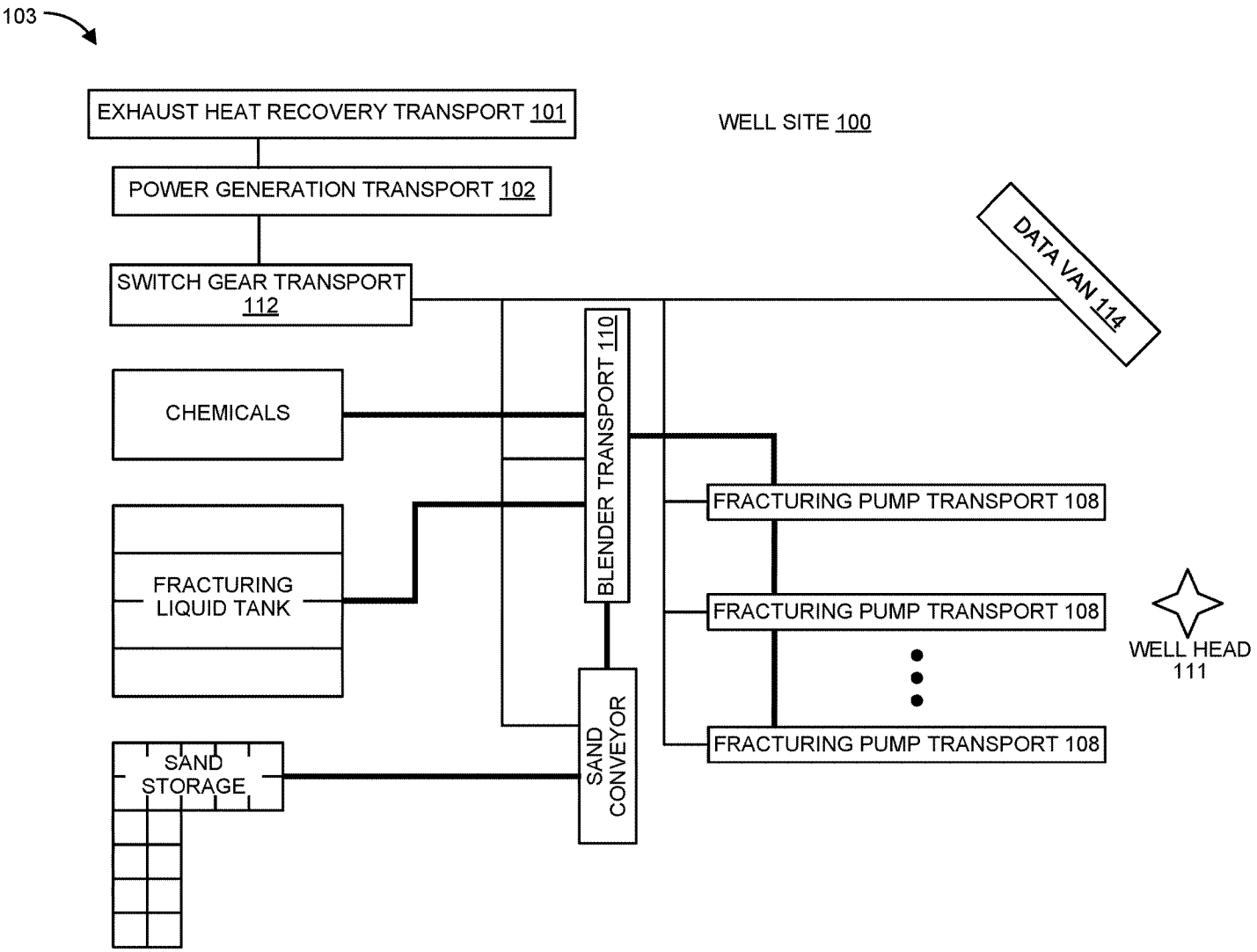
FIG. 1 is a schematic diagram of a mobile hydraulic fracturing system operating at a well site, in accordance with one or more embodiments.

While certain embodiments will be described in connection with the illustrative embodiments shown herein, the invention is not limited to those embodiments. On the contrary, all alternatives, modifications, and equivalents are included within the spirit and scope of the invention as defined by the claims. In the drawings, which are not to scale, the same reference numerals are used throughout the description and in the drawing figures for components and elements having the same structure.

DESCRIPTION

In the following description, for purposes of explanation, numerous specific details are set forth in order to provide a thorough understanding of the inventive concept. In the interest of clarity, not all features of an actual implementation are described. Moreover, the language used in this disclosure has been principally selected for readability and instructional purposes and may not have been selected to delineate or circumscribe the inventive subject matter, resort to the claims being necessary to determine such inventive subject matter. Reference in this disclosure to "one embodiment" or to "an embodiment" or "another embodiment" means that a particular feature, structure, or characteristic described in connection with the embodiment is included in at least one embodiment of the invention, and multiple references to "one embodiment" or "an embodiment" or "another embodiment" should not be understood as necessarily all referring to the same embodiment.

The terms "a," "an," and "the" are not intended to refer to a singular entity unless explicitly so defined, but include the general class of which a specific example may be used for illustration. The use of the terms "a" or "an" may therefore mean any number that is at least one, including "one," "one or more," "at least one," and "one or more than one." The term "or" means any of the alternatives and any combination of the alternatives, including all of the alternatives, unless the alternatives are explicitly indicated as mutually exclusive. The phrase "at least one of" when combined with a list of items, means a single item from the list or any combination of items in the list. The phrase does not require all of the listed items unless explicitly so defined.

As used herein, the term "transport" refers to any transportation assembly, including, but not limited to, a trailer, truck, skid, and/or barge used to transport relatively heavy structures, such as a gas turbine, a generator, air handling system, exhaust heat recovery apparatus, and the like.

As used herein, the term "trailer" refers to a transportation assembly used to transport relatively heavy structures, such as a gas turbine, a generator, air handling system, exhaust heat recovery apparatus, and the like, that can be attached and/or detached from a transportation vehicle used to pull or move the trailer. In one embodiment, the trailer may include the mounts and manifold systems to connect the trailer to other equipment.

This disclosure pertains to capturing and utilizing exhaust heat from a mobile power generation system (e.g., power generation transport) to generate heated source fluid. In one or more embodiments, the mobile power generation system includes a turbine-electric generator system that generates hot exhaust air as a by-product of producing electric power. The hot exhaust air may be released into atmosphere from an exhaust stack mounted on a transport of the mobile power generation system (e.g., exhaust stack mounted directly on a gas turbine & generator transport of the mobile power generation system, or exhaust stack mounted on a separate inlet and exhaust transport positioned adjacent to the gas turbine & generator transport of the mobile power generation system). In some embodiments, rather than releasing all of the exhaust air into atmosphere from the exhaust stack, a portion of the hot exhaust air may be siphoned off from an exhaust air flow path of the exhaust stack prior to it being released into atmosphere. This portion of the hot exhaust air may flow via an exhaust air connection into a separate exhaust heat recovery system (e.g., exhaust heat recovery apparatus, exhaust heat recovery transport). The exhaust air connection can be coupled to the exhaust stack at the outlet of the exhaust stack, or at any point along the exhaust air flow path downstream of an outlet of a heat generation source.

The exhaust heat recovery transport may be configured to couple to the inlet and exhaust transport of the power generation system (e.g., couple to the exhaust collector or exhaust stack of the gas turbine) via an exhaust air connection to receive the portion of the hot exhaust air in a controlled manner and utilize the hot exhaust air to heat a source fluid flowing through a heat transfer assembly of the exhaust heat recovery transport.

In some embodiments, the heat transfer assembly (e.g., heat exchanger coils) is disposed in a heat recovery flow path of the exhaust heat recovery transport. The heat transfer assembly may perform a first heat exchange operation (e.g., air-to-liquid heat exchange operation) by allowing the source fluid (e.g., a mixture of water and glycol) to flow through the heat transfer assembly in a closed loop. As the source fluid flows within and through the heat transfer assembly, the exhaust heat recovery transport transfers thermal energy from the hot exhaust air flowing through the heat recovery flow path and coming in contact with the heat transfer assembly without transforming the source fluid into a gaseous state (e.g., steam). The heat exchanger coils can run dry, which refers to being able to receive exhaust heat while the source fluid is not flowing through the heat exchanger coils. In other words, the source fluid does not need to continuously flow through the heat exchanger coils to prevent melting or other damage when the heat exchanger coils are thermally heated by the exhaust heat.

In some embodiments, to control and manage the temperature of the source fluid, the exhaust heat recovery transport may include a bypass flow path for the hot exhaust air to bypass the heat transfer assembly and exit to atmosphere via an exhaust disposed on the exhaust heat recovery transport without passing through the heat transfer assembly. For example, one or more control valves may regulate the flow (e.g., flow rate) of the hot exhaust air to the heat transfer assembly along the heat recovery flow path and release excess hot exhaust air to a bypass duct of the bypass flow path.

Further, the exhaust heat recovery transport may include one or more sensors (e.g., temperature sensors, pressure sensors, flow sensors, tank level sensors) to measure, e.g., a temperature, a flow rate, a pressure, and the like, of the incoming hot exhaust air, one or more pump assemblies (e.g., blowers) to pump the hot exhaust air through the heat recovery flow path and/or the bypass flow path, electric motors to drive the pump assemblies, one or more control drives to control and manage the electric motors (e.g., variable frequency drives (VFDs).

Still further, in some embodiments, to control and manage the source fluid temperature, the exhaust heat recovery transport may include one or more pump assemblies to pump the source fluid in the closed loop, electric motors to drive the pump assemblies, one or more control drives to control and manage the electric motors (e.g., variable frequency drives (VFDs)), and one or more control valves that regulate the source fluid flow rate, flow path, and temperature.

The exhaust heat recovery system may further include at least one exhaust. The exhaust may release to atmosphere the exhaust air received from the mobile power generation system and that has flowed through one or both of the heat recovery flow path and the bypass flow path. In some embodiments, the exhaust heat recovery transport may include a first exhaust disposed downstream of the heat transfer assembly and on the heat recovery flow path and a second separate exhaust on the bypass flow path.

The control drives and control valves may be part of or communicate with a control system to manage operations of the exhaust heat recovery system. For example, the control system may operate one or more control valves to regulate a flow of the hot exhaust air along the heat recovery flow path and regulate a flow of the hot exhaust air along the bypass flow path to be released via the exhaust to atmosphere without passing through the heat transfer assembly. By controlling the flow rate of the hot exhaust air through the heat transfer assembly, the control system may achieve and maintain a temperature of the source fluid discharged from the heat transfer assembly within a predetermined range (e.g., within a predefined minimum and a predefined maximum temperature). For example, if the source fluid is approaching the predefined maximum temperature threshold, the control system may control to operate one or more control valves thereby causing the incoming hot exhaust air to bypass the heat transfer assembly by flowing via the bypass flow path and exit to atmosphere through the exhaust of the exhaust heat recovery apparatus without passing.

The heated source fluid discharged out of the heat transfer assembly may have many applications. For example, the heated source fluid may be utilized to perform a second heat exchange operation (e.g., liquid-to-air heat exchange operation) to generate "clean" hot air. The exhaust heat recovery transport may include one or more second heat transfer assemblies to perform one or more of the second heat exchange operations. Each second heat exchange operation may be performed on the exhaust heat recovery transport or at one or more different destinations separate from the exhaust heat recovery transport. The second heat exchange operation may include flowing clean ambient air through an air flow path disposed with a heat transfer assembly (e.g., heat exchanger coils) while allowing the heated source fluid (continuously heated by performing the first heat exchange operation) to flow through the heat exchanger coils, thereby heating the clean ambient air flowing through the air flow path. The clean, hot air can be used for different applications like forced air heating, indoor heating, outdoor equipment heating, etc.

The heated source fluid can also be used in a hydraulic fracturing context to provide heated source water to fluid storage equipment (e.g., fracture tanks or a fracturing pond), a hydration unit, a blender unit, a hydration-blender unit, and/or other hydraulic fracturing equipment. As another example, the heated source fluid can be used to provide hot liquid glycol wraps to heat equipment (e.g., pipes). As another example, the heated source fluid can be used to supply heat for other applications. One example of an alternate heat application would be a water evaporation system. Another example of an alternate heat application would be heating inlet midstream gas prior to supplying the gas to a gas skid for hydraulic fracturing operations.

Example Mobile Hydraulic Fracturing System

FIG. 1 is a schematic diagram of a mobile hydraulic fracturing system 103 operating at a well site 100, in accordance with one or more embodiments. The well site 100 comprises a wellhead 111 (e.g., frac pad including multiple wells) and the mobile fracturing system 103 (e.g., hydraulic fracturing fleet, frac fleet or system). Generally, the mobile fracturing system 103 may perform fracturing operations to complete a well and/or transform a drilled well into a production well. For example, the well site 100 may be a site where operators are in the process of drilling and completing a well. Operators may start the well completion process (e.g., well completion operation) after drilling, running production casing, and cementing within the wellbore. The operators may also insert a variety of downhole tools into the wellbore and/or as part of a tool string used to drill the wellbore. After the operators drill the well to a certain depth, a horizontal portion of the well may also be drilled and subsequently encased in cement. The operators may subsequently remove the rig, and the mobile fracturing system 103 may be moved onto the well site 100 to perform the well completion operation (e.g., fracturing operation) that forces relatively high-pressure fracturing fluid through the wellhead 111 into subsurface geological formations to create fissures and cracks within the rock. The mobile fracturing system 103 may be moved off the well site 100 once the operators complete the well completion operation. Typically, the well completion operation for the well site 100 may last several days and even up to multiple months.

In some embodiments, the mobile fracturing system 103 may comprise a power generation transport 102 (e.g., mobile source of electricity; power generation system; turbine-electric generator transport; inlet and exhaust transport) configured to generate electricity by converting hydrocarbon fuel, such as natural gas, obtained from one or more sources (e.g., a producing wellhead) at the well site 100, from a remote offsite location, and/or another relatively convenient location near the power generation transport 102. That is, the mobile fracturing system 103 may utilize the power generation transport 102 as a power source that burns cleaner while being transportable along with other fracturing equipment. The generated electricity from the power generation transport 102 may be supplied to fracturing equipment to power fracturing operations at one or more well sites, or to other equipment in various types of applications requiring mobile electric power generation.

The power generation transport 102 may be implemented as a single-trailer power generation transport. In other embodiments, the power generation transport 102 may be implemented using two or more transports, and components of the power generation transport 102 may be arranged on the two or more transports in any reasonable manner. For example, the power generation transport 102 may be implemented using a two-transport design in which a first transport may comprise a turbine (e.g., gas turbine) and a generator, and a second transport may comprise an air filter box providing filtered combustion air for the turbine, and an exhaust stack that securely provides an exhaust system for exhaust air from the turbine. As another example, the power generation transport 102 may be implemented using a three-transport design in which a first transport may include a gas turbine, a second transport may include a generator, and a third transport may include an air handling system that provides filtered intake air for combustion by the turbine. Different configurations (single-trailer, dual-trailer, or three-trailer configurations) of the power generation transport 102 are described in detail in U.S. Pat. No. 9,534,473, issued Jan. 3, 2017, to Jeffrey Morris et al and entitled "Mobile Electric Power Generation for Hydraulic Fracturing of Subsurface Geological Formations" (describing a dual-trailer configuration); U.S. Pat. No. 11,434,763, issued Sep. 6, 2022, to Jeffrey Morris et al and entitled "Single-Transport Mobile Electric Power Generation" (describing a single-trailer configuration); U.S. Pat. No. 11,512,632, issued Nov. 29, 2022, to Jeffrey Morris et al and entitled "Single-Transport Mobile Electric Power Generation" (describing a single-trailer configuration); and U.S. application Ser. No. 17/732,280, filed Apr. 28, 2022, by Jeffrey Morris et al and entitled "Mobile Electric Power Generation System" (describing a three-trailer configuration), each of which is herein incorporated by reference in its entirety.

Although not shown in FIG. 1, the power generation transport or system 102 may include a variety of equipment for mobile electric power generation including a gas conditioning skid, a black start generator, a power source (e.g., gas turbine), a power source air inlet filter housing, a power source inlet plenum, a power source exhaust collector, an exhaust coupling member, a power source exhaust stack, a gearbox, a generator shaft, a generator, a generator air inlet filter housing, a generator ventilation outlet, a generator breaker, a transformer, a starter motor, and a control system. Other components on the power generation transport 102 may include a turbine lube oil system, a fire suppression system, a generator lube oil system, and the like.

In one embodiment, the power source may be a gas turbine. In another embodiment, power source may be another type of power source (e.g., diesel engine). The gas turbine may generate mechanical energy (e.g., rotation of a shaft) from a hydrocarbon fuel source, such as natural gas, liquefied natural gas, condensate, and/or other liquid fuels. For example, a shaft of the gas turbine may be connected to the gearbox and the generator such that the generator converts the supplied mechanical energy from the rotation of the shaft of the gas turbine to produce electric power. The gas turbine may be a commercially available gas turbine such as a General Electric NovaLT5 gas turbine, a Pratt and Whitney gas turbine, or any other similar gas turbine. The generator may be a commercially available generator such as a Brush generator, a WEG generator, or other similar generator configured to generate a compatible amount of electric power. For example, the combination of the gas turbine, the gearbox, and the generator within power generation transport 102 may generate electric power from a range of at least about 1 megawatt (MW) to about 60 MW (e.g., 5.6 MW, 32 MW, or 48 MW). Other types of gas turbine/generator combinations with power ranges greater than about 60 MW or less than about 1 MW may also be used depending on the application requirement.

In addition to the power generation transport 102, the mobile fracturing system 103 may include a switch gear transport 112, at least one blender transport 110, at least one data van 114, and one or more fracturing pump transports 108 that deliver fracturing fluid through the wellhead 111 to the subsurface geological formations. The switch gear transport 112 may receive electricity generated by the power generation transport 102 via one or more electrical connections. In one embodiment, the switch gear transport 112 may use 13.8 kilovolts (KV) electrical connections to receive power from the power generation transport 102. The switch gear transport 112 may transfer the electricity received from the power generation transport 102 to electrically connected fracturing equipment of the mobile fracturing system 103. The switch gear transport 112 may comprise a plurality of electrical disconnect switches, fuses, transformers, and/or circuit protectors to protect the fracturing equipment. In some embodiments, switch gear transport 112 may be configured to step down a voltage received from the power generation transport 102 to one or more lower voltages to power the fracturing equipment.

As shown in FIG. 1, the mobile fracturing system 103 located at the well site 100 may further include an exhaust heat recovery transport 101. The exhaust heat recovery transport 101 (e.g., exhaust heat recovery apparatus) may be configured to couple to a component (e.g., exhaust collector, exhaust stack) disposed downstream to an exhaust of the gas turbine of the power generation transport 102 (e.g., inlet and exhaust transport) in an operation mode to receive a portion of the exhaust air from the gas turbine and utilize the exhaust heat for heating up source fluid flowing through the exhaust heat recovery transport 101. The exhaust heat recovery transport 101 and the power generation transport 102 may be configured to be connected to each other (e.g., via an exhaust end connection) in an operation mode and may be separately and independently movable in a transportation mode.

In some embodiments, the exhaust air received by the exhaust heat recovery transport 101 may be the hot exhaust air released from the exhaust of the gas turbine. In other embodiments, the exhaust air received by the exhaust heat recovery transport 101 may further include ventilation and cooling exhaust air. The ventilation and cooling exhaust air may be released from the power generation transport 102 (e.g., from the gas turbine-generator transport) after passing through one or more flow paths to ventilate and cool one or more components mounted on the power generation transport 102. For example, the one or more components may include the gas turbine, the generator, transformers, variable frequency drivers, black start generator, and the like. Although not specifically shown in FIG. 1, the power generation transport 102 and/or the switch gear transport 112 may also provide electric power (e.g., power generated by the power generation transport 102) to power one or more components of the exhaust heat recovery transport 101. For example, power output from the power generation transport 102 at a relatively high voltage level (e.g., 13.8 KV) may be stepped down using a transformer mounted on the power generation transport 102 or on the switch gear transport 112 to a lower voltage level (e.g., 480 V), and the electric power at the lower voltage level may be output to the exhaust heat recovery transport 101 via an electrical cable connection.

Each fracturing pump transport 108 may receive the electric power from the switch gear transport 112 to power a prime mover. The prime mover converts electric power to mechanical power for driving one or more fracturing pumps of the fracturing pump transport 108. In one embodiment, the prime mover may be a dual shaft electric motor that drives two different frac pumps mounted to each fracturing pump transport 108. Each fracturing pump transport 108 may be arranged such that one frac pump is coupled to opposite ends of the dual shaft electric motor and avoids coupling the pumps in series. By avoiding coupling the pump in series, fracturing pump transport 108 may continue to operate when either one of the pumps fails or has been removed from the fracturing pump transport 108. Additionally, repairs to the pumps may be performed without disconnecting the system manifolds that connect the fracturing pump transport 108 to other fracturing equipment within the mobile fracturing system 103 and the wellhead 111. The fracturing pump transport 108 may implement (in whole or in part) a system for predicting frac pump component life intervals and setting a continuous completion event for a well completion design.

The blender transport 110 may receive electric power fed through the switch gear transport 112 to power a plurality of electric blenders. In one or more embodiments, the blender transport 110 may function independently from the switch gear transport 112 and the power generation transport 101 and be powered by other means such as a diesel engine or a natural gas reciprocating engine. A plurality of prime movers may drive one or more pumps that pump source fluid and blender additives (e.g., sand) into a blending tub, mix the source fluid and blender additives together to form fracturing fluid, and discharge the fracturing fluid to the fracturing pump transports 108. In one embodiment, the electric blender may be a dual configuration blender that comprises electric motors for the rotating machinery that are located on a single transport. In another embodiment, a plurality of enclosed mixer hoppers may be used to supply the proppants and additives into a plurality of blending tubs.

The data van 114 may be part of a control network system, where the data van 114 acts as a control center configured to monitor and provide operating instructions to remotely operate the exhaust heat recovery transport 101, the blender transport 110, the power generation transport 102, the fracturing pump transports 108, and/or other fracturing equipment within the mobile fracturing system 103. For example, the data van 114 may implement (in whole or in part) the control system for managing one or more heat transfer (e.g., air-to-liquid heat transfer, or liquid-to-air heat transfer) operations according to the present disclosure. In one embodiment, the data van 114 may communicate with the variety of fracturing equipment using a control network system that has a ring topology (or star topology). A ring topology may reduce the amount of control cabling used for fracturing operations and increase the capacity and speed of data transfers and communication.

Other fracturing equipment shown in FIG. 1, such as fracturing liquid (e.g., water) tanks, chemical storage of chemical additives, hydration unit, sand conveyor, and sandbox storage are known by persons of ordinary skill in the art, and therefore are not discussed in further detail. In one or more embodiments of the mobile fracturing system 103, one or more of the other fracturing equipment shown in FIG. 1 may be configured to receive power generated from the power generation transport 102. The control network system for the mobile fracturing system 103 may remotely synchronize and/or slave the electric blender of the blender transport 110 with the electric motors of the fracturing pump transports 108.

Example Exhaust Heat Recovery System

Figure 2A:
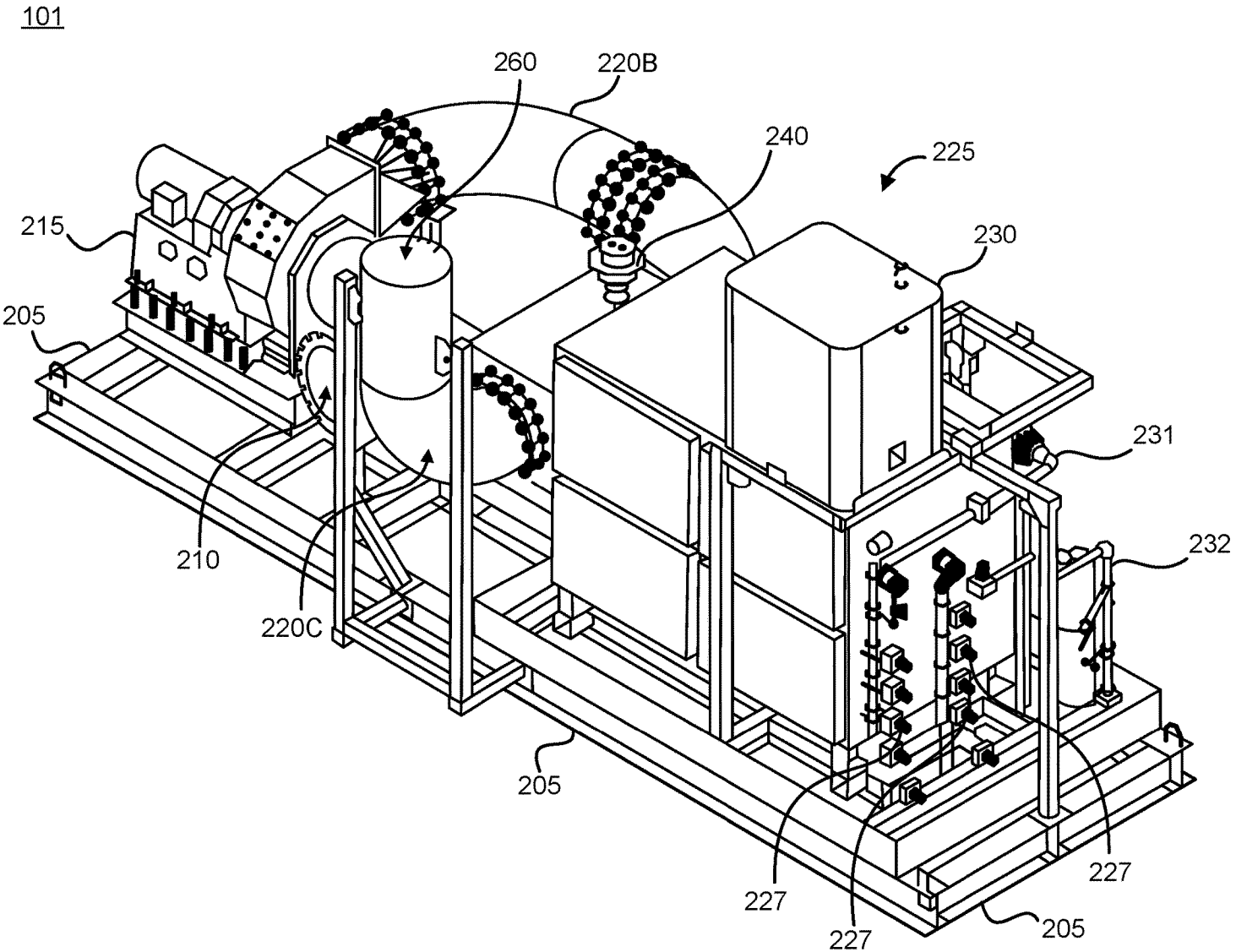
FIG. 2A is a schematic diagram showing an isometric view of an exhaust heat recovery transport of FIG. 1, in accordance with one or more embodiments.
Figure 2B:
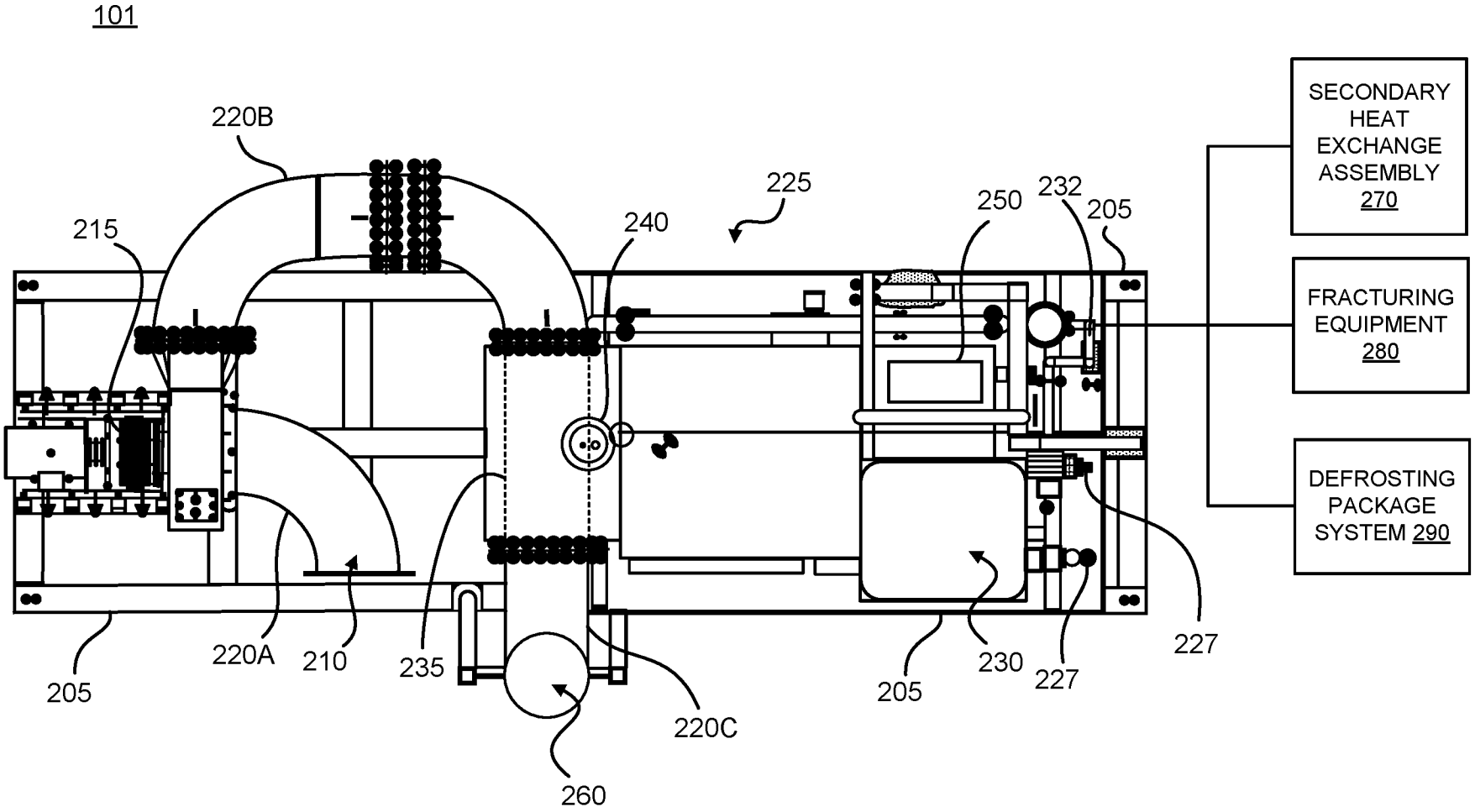
FIG. 2B is a schematic diagram showing a plan view of an exhaust heat recovery transport of FIG. 1, in accordance with one or more embodiments.

FIG. 2A is a schematic diagram showing an isometric view of the exhaust heat recovery transport 101 of FIG. 1, in accordance with one or more embodiments. FIG. 2B is a schematic diagram showing a plan view of the exhaust heat recovery transport 101 of FIG. 1, in accordance with one or more embodiments. FIG. 2B also illustrates downstream components of the mobile fracturing system 103 that may utilize the heated source fluid discharged from the exhaust heat recovery transport 101. The isometric view shown in FIG. 2A, and the plan view shown in FIG. 2B both illustrate the exhaust heat recovery transport 101 that is mounted to a base frame 205 (e.g., a skid). The base frame 205 may be removably mountable on a trailer to mobilize the exhaust heat recovery transport 101. During operation, the skid-mounted exhaust heat recovery transport 101 may be placed on the ground to perform the heat transfer. In other embodiments, the exhaust heat recovery transport 101 may be fixedly mounted to a base frame of a trailer to be configured as a mobile exhaust heat recovery transport.

As shown in FIG. 2A and FIG. 2B, a plurality of components may be mounted to the base frame 205 of the exhaust heat recovery transport 101. The components may include an exhaust air connection 210, a blower 215, ducts 220 (220A, 220B, 220C), a heat transfer assembly 225, heat exchanger coils 227, a fluid source 230, a source fluid inlet 231, a source fluid outlet 232, a bypass duct 235 (e.g., bypass line), a control valve assembly 240, a control system 250, and exhaust 260. Although not specifically shown in FIGS. 2A-2B, the exhaust heat recovery transport 101 may also include additional components like one or more electric motors that drive one or more pump assemblies, one or more control drives (e.g., VFDs), a plurality of sensors, and one or more secondary heat transfer assemblies (e.g., liquid-to-air heat exchangers; see FIGS. 6-7). In one or more embodiments, one or more of the components shown in FIGS. 2A-2B may be omitted. For example, in instances where adequate back pressure from a turbine exhaust is available, blower 215 and components associated with blower 215 may be omitted.

The plurality of sensors may include temperature sensors, pressure sensors, flow rate sensors, and the like. For example, the sensors may be configured to measure a temperature, a flow rate, and/or a pressure of the hot exhaust air that is received via the exhaust air connection 210. The measurements may be taken at one or more points along one or more flow paths defined by the exhaust heat recovery transport for the hot exhaust air.

As another example, the sensors may be configured to measure a temperature, a flow rate, and/or a pressure of the source fluid flowing through the heat transfer assembly 225. The measurements for the source fluid may also be taken at one or more points along a flow path for the source fluid that may originate and terminate at the fluid source 230 in a closed loop.

In an operation mode, the exhaust heat recovery transport 101 may be positioned at a predetermined orientation and distance relative to the power generation transport 102 (e.g., inlet and exhaust transport in a two-trailer configuration of a power generation system) such that the exhaust air connection 210 of the exhaust heat recovery transport 101 can be connected to an outlet (e.g., exhaust collector, exhaust stack, etc.) of the gas turbine of the power generation transport 102 via a connection (e.g., an S-joint, a flex joint, a fixed pipe). During the transportation mode, the connection connecting the exhaust air connection 210 to the outlet of the gas turbine may be disconnected to allow the exhaust heat recovery transport 101 and the power generation transport 102 to be separately and independently movable. As shown in FIGS. 2A-2B, in some embodiments, the exhaust air connection 210 may be disposed on a longitudinal side of the exhaust heat recovery transport 101 that faces a longitudinal side of the power generation transport 102 (e.g., gas turbine-generator transport) when the transports 101 and 102 are positioned adjacent to each other in the operation mode. In one or more embodiments, one or more components (e.g., ducts 220B and 220C, exhaust 260) may be removably affixed during the operation mode may be detached during the transportation mode.

A byproduct of the power generation transport (e.g., inlet and exhaust transport) 102 is exhaust air that can range from about 600 degrees fahrenheit (° F.) to about 1300° F. (e.g., about 315 degrees Celsius (° C.) to about 704° C.). In the operation mode, the exhaust heat recovery transport 101 may be positioned adjacent to the power generation transport 102 and connected via the exhaust air connection 210 to receive some of (e.g., a portion of) of the hot exhaust air output from the power generation transport 102.

The blower 215 may be disposed on the exhaust heat recovery transport 101 and controlled by the control system 250 to regulate a flow rate of the hot exhaust air to the exhaust heat recovery transport 101. The blower 215, controlled by control system 250, allows the system to maintain a stream of exhaust air optimized to meet the needs of the heat transfer assembly 225. Ducts 220 may include a plurality of duct sections (e.g., 220A, 220B, 220C, 235) to define flow paths for the exhaust air flowing through the exhaust heat recovery transport 101. For example, a heat recovery flow path may correspond to a flow path that extends from the exhaust air connection 210 and through the duct section 220A, the blower 215, the duct section 220B, the valve assembly 240, the heat transfer assembly 225, the duct section 220C, and the exhaust 260. As another example, a bypass flow path may correspond to a flow path that extends from the exhaust air connection 210 and passes through the duct section 220A, the blower 215, the duct section 220B, the bypass duct 235, the duct section 220C, and the exhaust 260.

Although not shown in FIGS. 2A-2B, in some embodiments, the exhaust 260 for the heat recovery flow path may be different from an exhaust for the bypass flow path. As shown in FIG. 2A, the exhaust 260 may be fixedly mounted to the base frame 205 of the transport 101. Although not specifically shown, the exhaust 260 may further include an exhaust extension configured for noise control. The exhaust extension may comprise a plurality of silencers that reduce noise from the exhaust air being released into the atmosphere from the exhaust. The exhaust 260 may be adapted to release the exhaust air into atmosphere at a predetermined height to reduce noise pollution and to reduce danger from the hot exhaust air to any operation personnel working in a vicinity of the transport 101. Releasing the exhaust air into the atmosphere at the predetermined height also reduces the likelihood of operation personnel inhaling the noxious exhaust air fumes.

Also, although not shown in FIGS. 2A-2B, the exhaust heat recovery transport 101 may define more than two flow paths and may define more than one heat recovery flow path and more than one bypass flow path. For example, in some embodiments, a first heat recovery flow path may be designed to heat the source fluid and maintain its temperature at a first target temperature, and a second heat recovery flow path may be designed to heat the source fluid and maintain its temperature at a second target temperature that is higher than the first target temperature.

The heat transfer assembly 225 may be disposed on the heat recovery flow path to receive the hot exhaust air and extract thermal energy from the hot exhaust air by causing the air to come into contact with one or more heat conducting elements, such as heat exchanger coils 227 disposed within the heat transfer assembly 225.

The fluid source 230 may store the source fluid which may include, but is not limited to, water, or a water glycol mixture (e.g., 50% water, 50% glycol). Other fluids that have a high heat thermal transfer index can also be used as the source fluid. In one or more embodiments, transfer lines for the source fluid may be insulated. The fluid source 230 may correspond to any type of storage tank (e.g., container, bin, etc.) for storing the source fluid and that can handle the heated source fluid. An outlet of the fluid source 230 may connect to an inlet 231 to the heat conducting elements 227 of the heat transfer assembly 225. After passing through the heat transfer assembly 225 and absorbing the thermal energy, the heated source fluid may be discharged from an outlet 232 of the heat transfer assembly and sent to one or more destinations, such as one or more secondary heat transfer assemblies 270 (e.g., liquid-to-air heat transfer assemblies; FIG. 2B), other fracturing equipment 280, defrosting package system 290, back to the fluid source 230, and the like. The source fluid may thus circulate in a closed loop from the outlet of the fluid source 230 and back to an inlet of the fluid source 230.

In some embodiments, the source fluid may flow through the heat transfer assembly 225 in an open loop configuration. That is, for example, the source fluid may be water or other mixture of one or more liquids (e.g., frac fluid), and the heat transfer assembly 225 may heat the liquid as it passes through the heat transfer assembly in a "one-way" configuration. The heated liquid may then directly be used for different applications, such as for pumping downhole into a wellbore as frac fluid. Thus, fresh liquid may continuously be supplied from a source to the heat transfer assembly 225, the liquid may be heated to a predetermined temperature, and the heated liquid may be discharged out of the exhaust heat recovery transport 101 in the "one-way" configuration for use in different applications.

To control, maintain, and/or manage a temperature of the source fluid discharged from the outlet 232, the exhaust heat recovery transport 101 may include the control valve assembly 240 and the control system 250. The control valve assembly 240 may include at least one control valve and at least one actuator to control the operation of the control valve based on an instruction signal from the control system 250. The control valve may be any type of valve such as a butterfly valve, check valve, globe valve, ball valve, gate valve, diaphragm valve, and the like. The control valve may be a three-way valve adapted to distribute the incoming hot exhaust air flow between two separate flow paths: the heat recovery flow path and the bypass flow path, or route the entire air flow to one of the heat recovery flow path and the bypass flow path. The actuator may utilize hydraulics, pneumatics, electronics, and the like to actuate the control valve based on an operation signal from the control system 250.

In some embodiments, the actuator may also include mechanical actuation components as a safety backup to close the control valve and stop the heat transfer operation in the heat transfer assembly 225 in case of an emergency. The control valve of the assembly 240 may be adapted to distribute the flow of the hot exhaust air between the heat recovery flow path and the bypass flow path based on the current actuation position of the valve. For example, when the valve is in a fully open position, the entire incoming flow of the hot exhaust air may be directed to the heat transfer assembly 225 via the heat recovery flow path. When the valve is in a fully closed position, the entire incoming flow of the hot exhaust air may be directed to bypass the heat transfer assembly and directly be released into atmosphere from the exhaust 260 via the bypass flow path. When the valve is in some intermediate position between the fully open and fully closed positions, the flow of the incoming hot exhaust air is distributed between the heat recovery flow path and the bypass flow path in proportion to the intermediate position. The valve, controlled by the actuator and the control system 250, may be powered by power from power generation transport 102 to regulate the flow of exhaust air into heat transfer assembly 225, and to release excess exhaust air into atmosphere via the exhaust 260.

The control system 250 may include a controller (e.g., a programmable logic controller (PLC)) for controlling operations of the plurality of sensors, the one or more control drives (e.g., VFDs) that control and manage the electric motors, the blower 215, and the control valve assembly 240, to regulate the temperature of the source fluid from the fluid source 230.

In some embodiments, based on sensor data, the control system 250 may control operations of one or more components (e.g., pump assemblies, motors, control drives, control valve assembly 240, control manifold, etc.) of the exhaust heat recovery apparatus 101 to cause a temperature of the source fluid discharged from the outlet 232 to be maintained within a predetermined temperature range (e.g., between a predetermined minimum and maximum temperature (e.g., between 100° F.-800° F.), or at a predetermined target temperature (e.g., about 150° F.). For example, the sensor data may include data regarding the flow rate, pressure, and/or temperature of the exhaust air flowing into the exhaust air connection 210, data regarding the flow rate, pressure, and/or temperature of the exhaust air flowing through the duct section 220B, ambient air temperature data, data regarding the flow rate, pressure, and/or temperature of the source fluid stored in the fluid source 230, data regarding the flow rate, pressure, and/or temperature of the source fluid at the inlet 231 of the heat transfer assembly 225, data regarding the flow rate, pressure, and/or temperature of the source fluid at the outlet 232 of the heat transfer assembly 225, data regarding the flow rate, pressure, and/or temperature of the source fluid at an inlet and/or outlet of the fluid source 230, and the like.

Thus, for example, if the temperature of the source fluid discharged from the outlet 232 is below a minimum threshold, the control system 250 may control to operate the control valve assembly 240 such that the control valve is in a fully open position, and the entire incoming flow of the hot exhaust air is delivered to the heat transfer assembly 225 via the heat recovery flow path. As another example, if the temperature of the source fluid discharged from the outlet 232 is above a maximum threshold, the control system 250 may control to operate the control valve assembly 240 such that the control valve is in a fully closed position, and the entire incoming flow of the hot exhaust air is directed to bypass the heat transfer assembly 225 and directly be released into atmosphere from the exhaust 260 via the bypass flow path. As another example, the control system 250 may regulate an operation speed of the blower 215 (e.g., to control the flow rate of the incoming hot exhaust air), and/or regulate one or more electric motors to regulate a flow rate of the source fluid flowing through the heat transfer assembly 225 based on the sensor data to manage the temperature of the source fluid and based on data regarding a current heat consumption state of the heated source fluid.

The heated source fluid discharged from the outlet 232 of the heat transfer assembly 225 may be discharged to one or more destinations. As shown in FIG. 2B, there may be a variety of use cases for the heated source fluid discharged from the outlet 232 of the exhaust heat recovery transport 101, such as use cases related to fracturing operations at a well site. For example, the exhaust heat recovery transport 101 can send and provide the heated source fluid to one or more destinations on and/or off the well site.

Using FIGS. 2A-2B as an example, the exhaust heat recovery transport 101 is able to send the heated source fluid back to the fluid source 230 (e.g., storage tank) without any intervening heat sink operation, to one or more secondary heat exchange assemblies 270 located on the well site (e.g., assemblies to generate forced "clean" hot air for various hot air applications), and other fracturing equipment 280 (e.g., a blender unit, a hydration unit, a hydration-blender unit, frac pump transport, data van, piping, power generation transport, switch gear transport). Additionally, or alternatively, the heated source fluid could be sent to the defrosting package system 290 to thaw a variety of other equipment located at the wellsite, such as wellheads, fracturing pipes, etc. For example, the heated source fluid (e.g., water glycol mixture) may be pumped through climate hoses and/or other flexible tubing that wraps around pipes and/or other equipment at the wellsite. The heat from the source fluid would provide thermal energy that thaws the equipment at the wellsite and maintain the equipment at a desirable operating temperature.

Figure 3A:
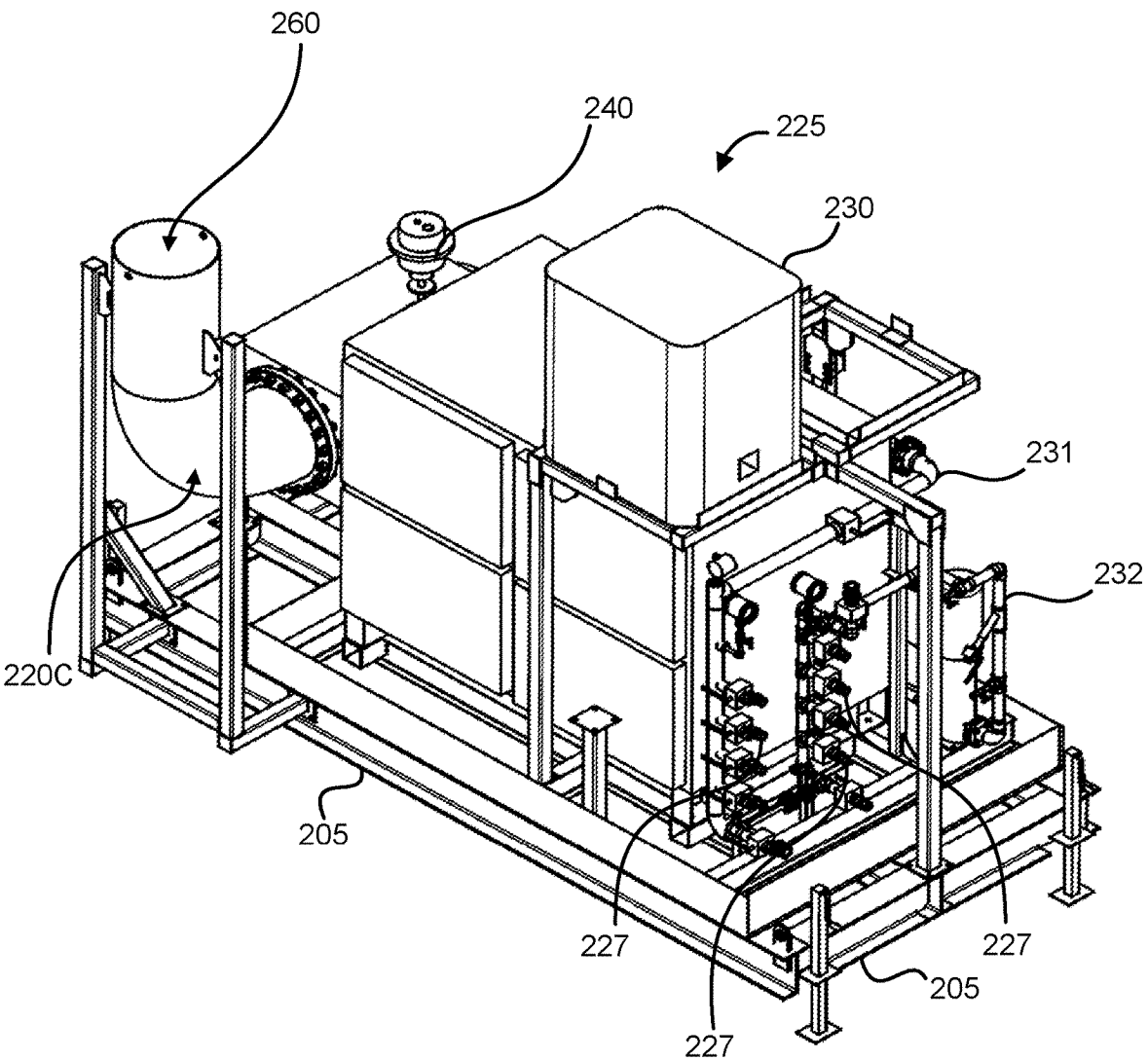
FIG. 3A is a schematic diagram showing an isometric view of an exhaust heat recovery transport of FIG. 1, in accordance with one or more embodiments.
Figure 3B:
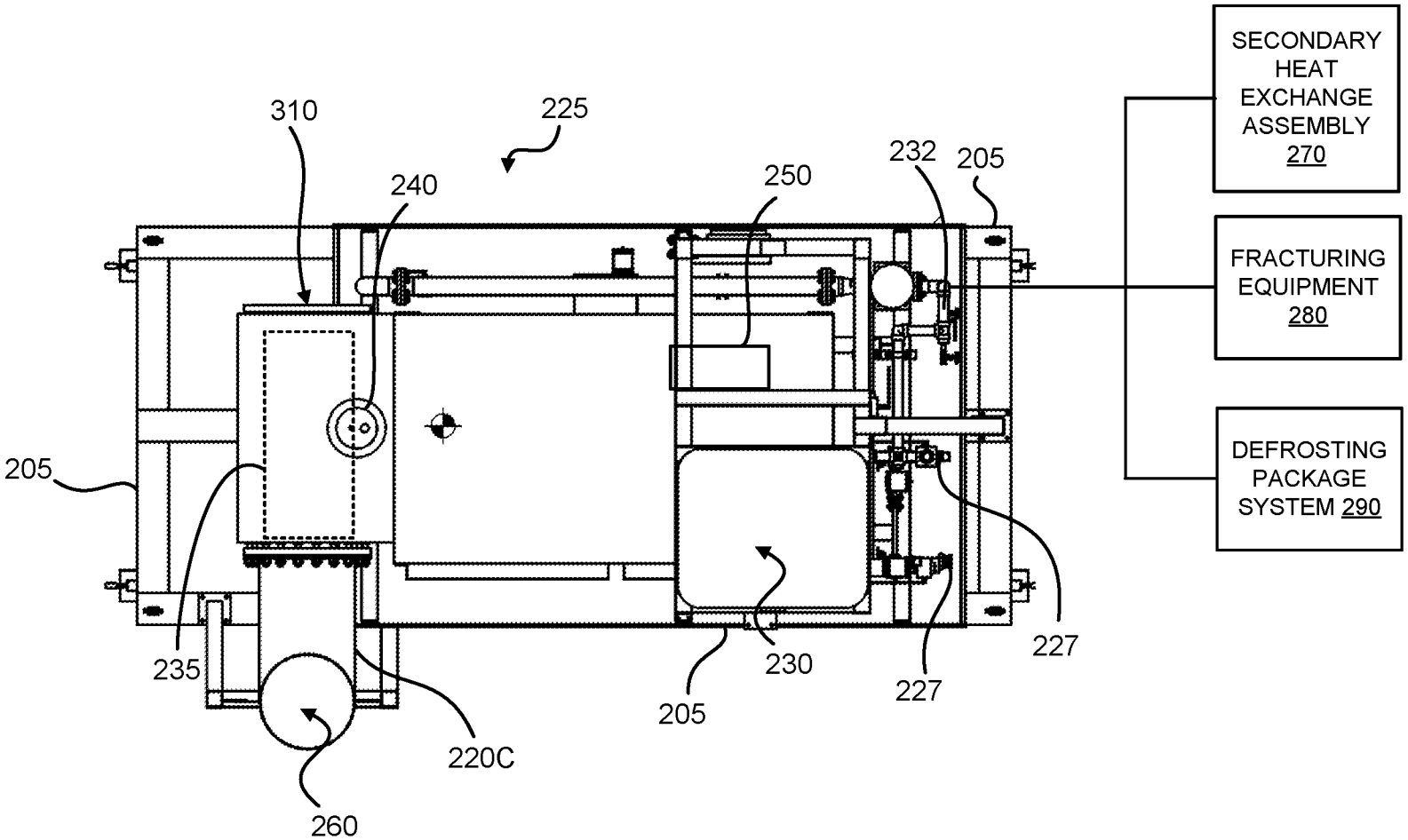
FIG. 3B is a schematic diagram showing a plan view of an exhaust heat recovery transport of FIG. 1, in accordance with one or more embodiments.
Figure 4A:
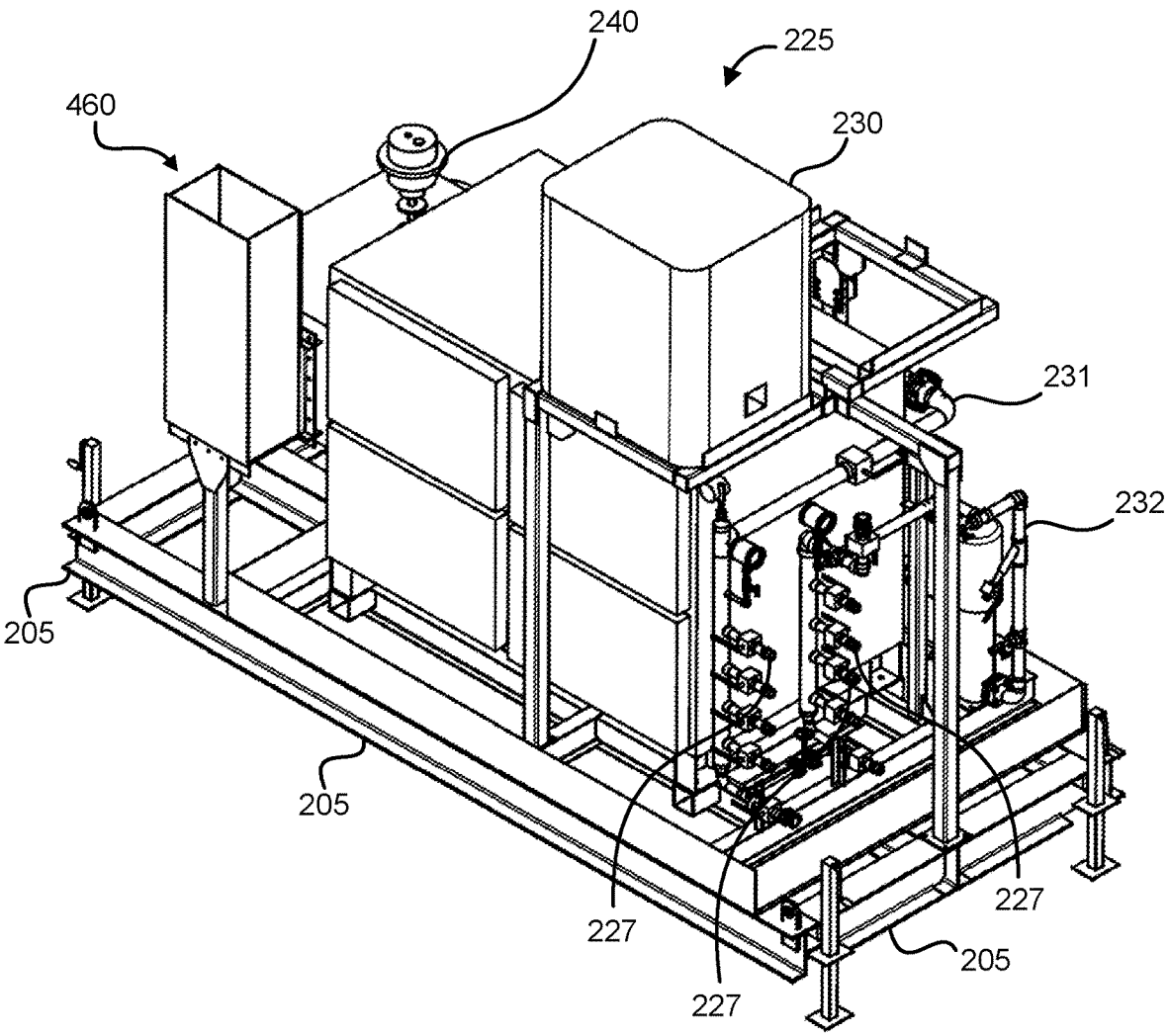
FIG. 4A is a schematic diagram showing an isometric view of an exhaust heat recovery transport of FIG. 1, in accordance with one or more embodiments.
Figure 4B:
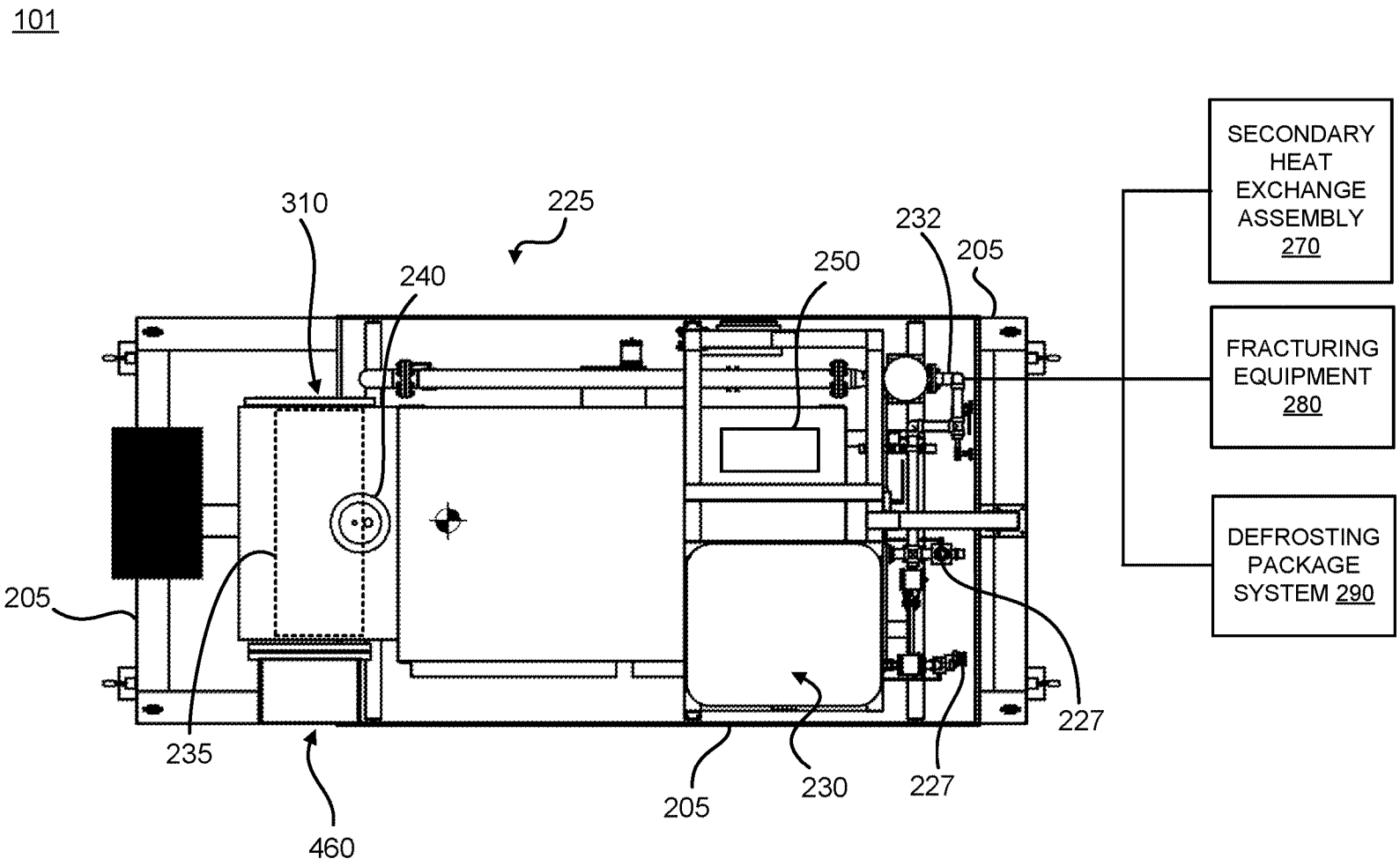
FIG. 4B is a schematic diagram showing a plan view of an exhaust heat recovery transport of FIG. 1, in accordance with one or more embodiments.

The configuration shown in FIGS. 2A-2B is not intended to be limiting. Alternate configurations of the exhaust heat recovery transport 101 could be devised without departing from the spirit and scope of the present disclosure. For example, as shown in FIGS. 3A, 3B, 4A, and 4B, the blower 215 and ducts 220A and 220B may be omitted from the exhaust heat recovery transport 101. As shown in FIGS. 3B and 4B, exhaust air connection 310 may be disposed on a longitudinal side of the exhaust heat recovery transport 101 that is opposite to a longitudinal side of the exhaust heat recovery transport 101 with the exhaust 260. FIGS. 4A-4B show another exemplary configuration of the exhaust heat recovery transport 101 that includes an angular, fixedly mounted exhaust 460. As shown in FIGS. 4A-4B, plan dimensions (e.g., length and width in a plan view) of the exhaust 460 are within plan dimensions of the base frame 205 of the exhaust heat recovery transport 101. Other components mounted on the exhaust heat recovery transport 101 in FIGS. 3A, 3B, 4A, and 4B that are the same as components mounted on the exhaust heat recovery transport 101 in FIGS. 2A-2B are marked with the same reference numerals and detailed description of these components is omitted.

Figure 5:
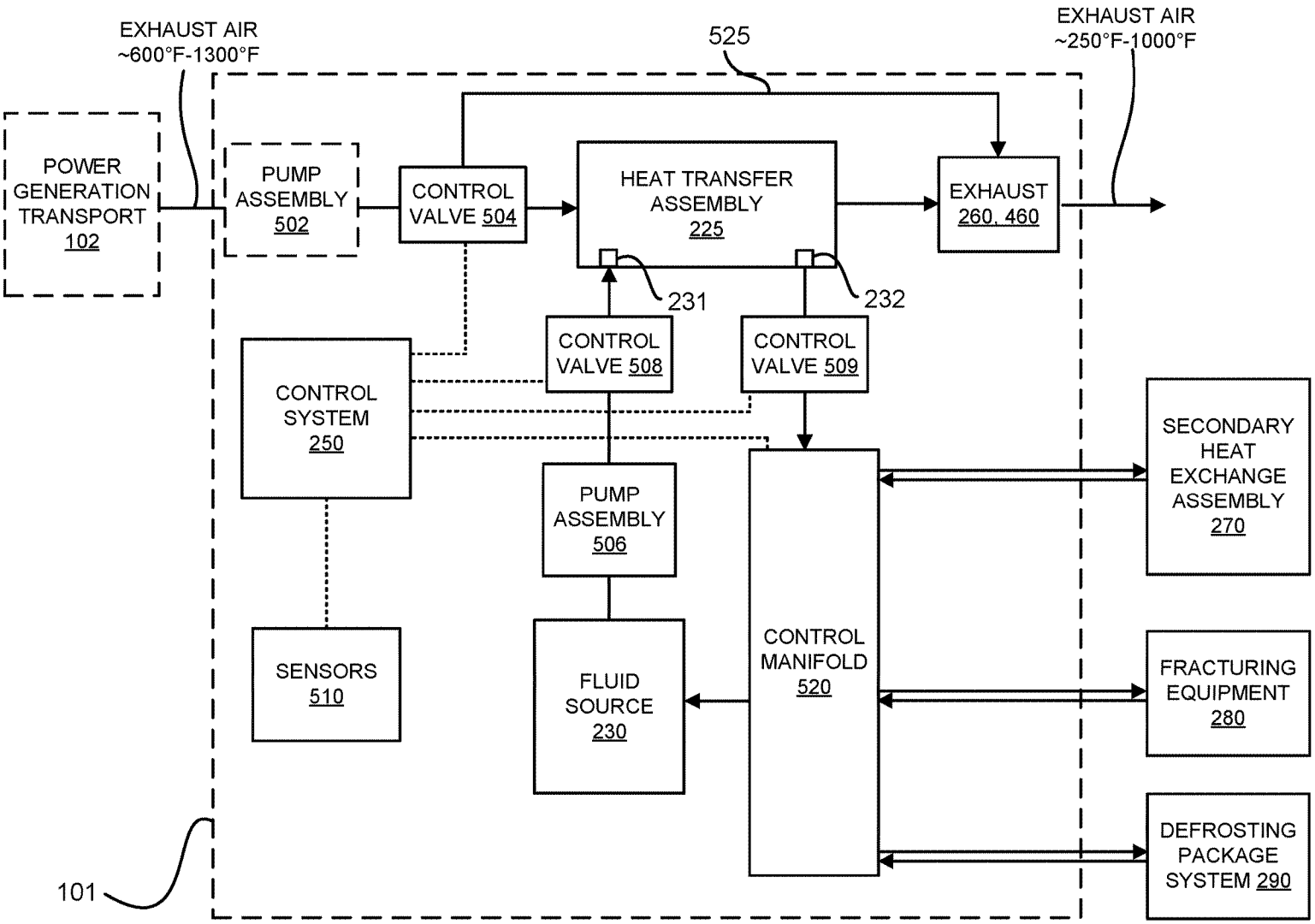
FIG. 5 is a block diagram of an operating environment of an exhaust heat recovery transport of FIG. 1, in accordance with one or more embodiments.

FIG. 5 is a block diagram of an operating environment of the exhaust heat recovery transport 101, in accordance with one or more embodiments. The heat transfer assembly 225 of the exhaust heat recovery transport 101 receives exhaust air (e.g., via the exhaust air connection 210, 310) from, e.g., an exhaust stack of the inlet and exhaust transport (e.g., power generation transport 102), where the exhaust air ranges in temperature from about 600° F. to about 1300° F. One of the reasons the turbine-electric generator transport produces exhaust air with varying temperatures is because of the varying load the turbine-electric generator transport supplies power to. Moreover, the exhaust air flow rate for the turbine-electric generator transport may also vary depending on the amount of power load.

As the power load for the turbine-electric generator transport increases, so does the temperature and flow rate of the exhaust air. For example, when the turbine-electric generator transport experiences a zero percent power load, the temperature of the exhaust air could be about 600° F. and have an exhaust air flow rate of about 180,000 pounds per hour (lbs/hr). If the turbine-electric generator transport experiences about a 60 percent power load, the temperature of the exhaust air is about 880° F. with an exhaust air flow rate of about 570,000 (lbs/hr). Stated another way, for a fracturing operation context, when the turbine-electric generator transport is providing electric power to drive more frac pump assemblies, the turbine-electric generator transport provides more British thermal units (BTUs) than when the turbine-electric generator transport provides no electric power or the number of frac pump assemblies in use decreases. The temperature and flow rate of the exhaust air, thus, varies depending on the power load.

In some embodiment, the exhaust heat recovery transport 101 may utilize a pump assembly 502 (e.g., blower 215) and a control valve 504 to adjust a pumping pressure and flow rate of the hot exhaust air received from the power generation transport 102. In some embodiments, the pump assembly 502 may be omitted and the flow rate and pressure of the incoming hot exhaust air may depend on the power load of the gas turbine, the back pressure created, and the location of the exhaust interconnect.

The control valve 504 regulates the flow rate or amount of incoming exhaust air that bypasses the heat transfer assembly 225. The exhaust heat recovery transport 101 utilize the control valve 504 to regulate the temperature of the source fluid at the outlet 232 and prevent overheating of the source fluid. Thus, for example, if control manifold 520 is not utilizing the thermal energy of the heated source fluid for any application currently, the control system 250 may regulate control valve 504 to bypass the hot exhaust air via the bypass flow path 525 to release it to atmosphere via the exhaust 260.

FIG. 5 also illustrates that the temperature of the exhaust air reduces as the exhaust air exits the heat transfer assembly 225 and enters the exhaust 260 (or 460) of the exhaust heat recovery transport 101. The temperature of the exhaust air that exits the exhaust heat recovery transport 101 may range from about 250° F. to about 1000° F. depending on the temperature of the exhaust air received at the exhaust air connection 210, the temperature and/or flow rate of the source fluid, and an operation state of the control valve 504. For example, if the control valve 504 is in a closed state to divert all incoming exhaust air to the bypass flow path 525 (based on the current temperature of the source fluid at the outlet 232 being high), the exhaust air exiting the exhaust 260 may be closer to 1000° F. While at higher thermal energy consumption loads (e.g., higher heat sink due to heat transfer at assembly 270, equipment 280, system 290, and the like), the exhaust air exiting the exhaust 260 may be as low as 250° F. Variation of the temperature of the exhaust air exiting the exhaust 260 can originate from the incoming temperature of the exhaust air, the flow rate of the exhaust air, the operation state of the heat transfer assembly 225 as controlled by the control valve 504, the incoming temperature for the source fluid, the flow rate of the source fluid, and/or the thermal energy consumption load on the heated source fluid. In some embodiments, the exhaust heat recovery transport 101 may be configured to generate thermal energy in the form of the heated source fluid of up to about 1 million BTUs per hour.

In FIG. 5, the exhaust heat recovery transport 101 utilizes a pump assembly 506 and a control valve 508 to adjust a pumping pressure and a flow rate of the source fluid flowing from the fluid source 230 into the heat transfer assembly 225 via the inlet 231 to obtain, regulate, and maintain a desired or specific temperature for the source fluid at the outlet 232. The exhaust heat recovery transport 101 may also include a plurality of sensors 510 (e.g., flow rate sensors, pressure sensors, temperature sensors, etc.) to measure various metrics like the incoming temperature of the source fluid at the inlet 231, temperature of the source fluid discharged at the outlet 232, a temperature and flow rate of the exhaust air at the control valve 504, a temperature of the source fluid flowing back into the fluid source 230 from control manifold 230, and the like.

The exhaust heat recovery transport 101 may further include a control manifold 520 to divert or discharge the heated source fluid from the outlet 232 to one or more destinations located on or off the exhaust heat recovery transport 101. For example, the control manifold 520 may include one or more control valves, pump assemblies, and manifolds to control discharge of the heated source fluid to one or more destinations, such as the one or more secondary heat exchange assemblies 270, other fracturing equipment 280, defrosting package system 290, back to the fluid source 230, and the like.

In one or more embodiments, the pump assemblies 502 and 506 may be driven by one or more electric motors. Examples of electric motors the exhaust heat recovery transport 101 may utilize include induction motors and/or permanent magnet motors. The exhaust heat recovery transport 101 may also include the control system 250 to control one or more drives (e.g., VFDs) that monitor and control the electric motors. The electric motors and the other electronic components (e.g., control valves, actuators, control manifold) of the exhaust heat recovery transport 101 may be powered using a 480-volt power supply that either may be fed from a transformer located on the exhaust heat recovery transport 101 or provided via a 480-volt electrical connection. For example, a transformer mounted on the exhaust heat recovery transport 101 is configured to receive a relative higher voltage (e.g., 13.8 kilovolts) via an electrical connection (e.g., from the power generation transport 102) and step down the voltage level to 480-volts to power the electric components of the transport 101. In another example, the exhaust heat recovery transport 101 may not have a mounted transformer and instead receive power via a 480-volt electrical connection directly from other equipment (e.g., the power generation transport 102). Other embodiments of the exhaust heat recovery transport 101 could utilize other voltages to power the electric components thereof.

The control system 250 may also include a controller to communicate with and operate the control valves 504, 508, and 509, and the control manifold 520, and one or more drives (e.g., VFDs) to regulate the temperature for the source fluid and route heated source fluid to various destinations. For example, the control system 250 may be configured to control the electric components of the exhaust heat recovery transport 101 such that the source fluid circulates in a closed loop within the heat transfer assembly until it reaches a desired temperature. After the heat transfer assembly 225 increases the temperature of the source fluid to the desired or specific temperature, the control system 250 may operate the control valve 509 to discharge the heated source fluid out of the heat transfer assembly 225 to control manifold 520.

In FIG. 5, the control system 250 communicates with control valves 508 and 509 and VFDs to monitor, control, and regulate the source fluid's flow rate into and/or discharge out of the heat transfer assembly 225. Further, the control system 250 communicates with control valve 504 to control and regulate the flow rate of the hot exhaust air flowing into the heat transfer assembly 225. Still further, the control system 250 communicates with the control manifold 520 to divert the heated source fluid to one or more destinations, and route the source fluid from the destinations back to the fluid source 230.

The controller may be a PLC or include a PLC that receives information from the sensors 510, such as fluid flow rate from one or more flow meters, temperature from one or more resistance temperature detection (RTD) sensors, pumping pressures from one or more pressure sensors and/or transmitters, sensors for measuring exhaust air temperature and flow rate. Based on the sensor information, the controller provides instructions to control valves 504, 508, 509, and control manifold 520 to control operations of the transport 101. By doing so, the controller may modify the source fluid's flow rate, pumping pressure, flow path, and/or the hot exhaust air's flow rate or flow path to obtain and maintain a target temperature for the source fluid and route the heated source fluid to desired destinations based on predetermined criteria or based on user operation. For example, the controller may communicate with a data van via a network connection and receive control instructions therefrom regarding routing the heated source fluid to one or more destinations based on the predetermined conditions (e.g., target temperature) being met.

Example Secondary Heat Exchange Assembly

Figure 6:
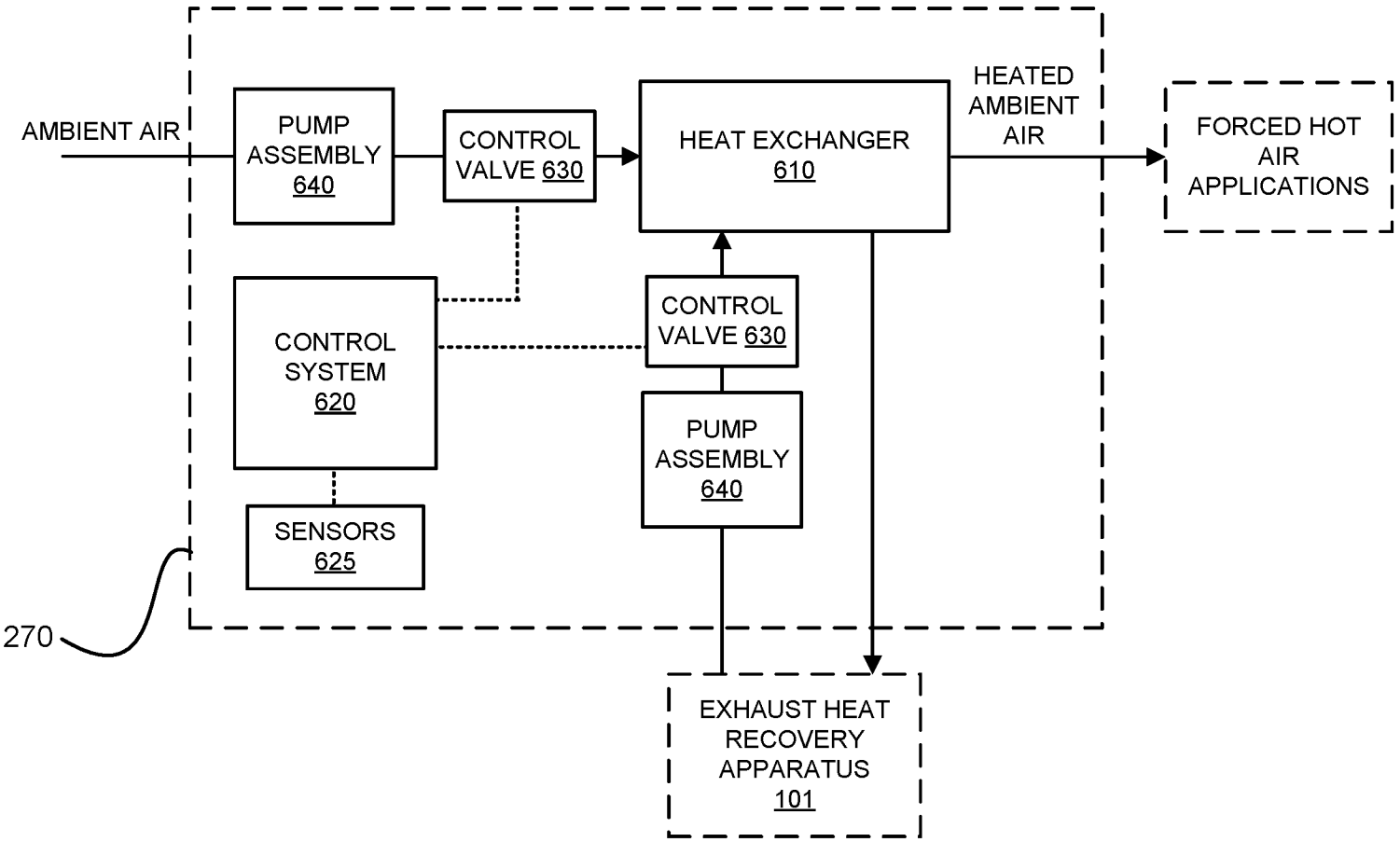
FIG. 6 is a block diagram of an operating environment of a secondary heat exchange assembly, in accordance with one or more embodiments.

FIG. 6 is a block diagram of an operating environment of the secondary heat exchange assembly 270, in accordance with one or more embodiments. In one or more embodiments, the secondary heat exchange assembly 270 (e.g., second heat transfer assembly) may be utilized at one or more destinations (e.g., at one or more locations or transports of the frac fleet at the well site) to generate hot "clean" air (e.g., liquid-to-air heat exchange) for one or more applications (e.g., forced ambient air heating system). In one or more embodiments, the secondary heat exchange assembly 270 may be utilized to generate hot liquid (e.g., liquid-to-liquid heat exchange) for one or more applications. More than one heat exchange operations may be performed at the secondary heat exchange assembly 270 (e.g., liquid-to-air heat exchange followed by air-to-liquid heat exchange). The secondary heat exchange assembly 270 may be configured to produce thermal energy in the form of the heated fluid (air or liquid) of up to about 200,000 BTUs per hour. In some embodiments, multiple (e.g., five to ten) heat exchange assemblies 270 may operate in parallel to utilize the thermal energy of the heated source fluid output from the heat transfer assembly 225 of the exhaust heat recovery transport 101. Each secondary heat exchange assembly 270 may work independently, cycle on and off, and also may be a starting point of a smaller subsystem. For example, a liquid-to-liquid exchange assembly 270 may branch off multiple glycol wraps to nearby destinations. In some embodiments, the secondary heat exchange assembly 270 may be mounted to the base frame 205 and disposed on the exhaust heat recovery transport 101. In other embodiments, the secondary heat exchange assembly 270 may be mounted to a skid or another transport and disposed at a location separate from the exhaust heat recovery transport 101.

As shown in embodiment of FIG. 6, the secondary heat exchange assembly 270 may include a heat exchanger (e.g., liquid-to-air heat exchanger, liquid-to-liquid heat exchanger) 610, a control system 620, sensors 625, control valves 630, and pump assemblies 640. Ambient air (which may be filtered "clean" ambient air) may be routed via pump assembly 640 and control valve 630 into the heat exchanger 610. The heat exchanger 610 may include heat conducting elements (e.g., heat exchanger coils) that circulate the heated source fluid received from the exhaust heat recovery transport 101. The ambient air may contact the heat conducting elements in the heat exchanger 610 and absorb the thermal energy from the heated source fluid circulating in the heat conducting elements, thereby heating the ambient air. The hot "clean" air may be output from the assembly 270 and utilized for different forced hot air applications (e.g., for heating indoor air in a data van). The control system 620 may be configured to receive sensor data from the sensors (e.g., temperature sensors, flow rate sensors, pressure sensors) and based on the sensor data and operating instructions that may be received via a network controller (e.g., from the data van), the control system 620 may control one or more of the control valves 630 and the pump assemblies 640 (e.g., via corresponding VFDs and electric motors) to achieve and maintain a predetermined temperature or temperature range for the heated ambient air discharged from the assembly 270. In some embodiments, the electric components of the assembly 270 may be powered by the power generation transport 102 via an electric connection. In one or more embodiments, the secondary heat exchange assembly 270 may function independently of the heat transfer assembly 225 of the exhaust heat recovery transport 101.

Figure 7:
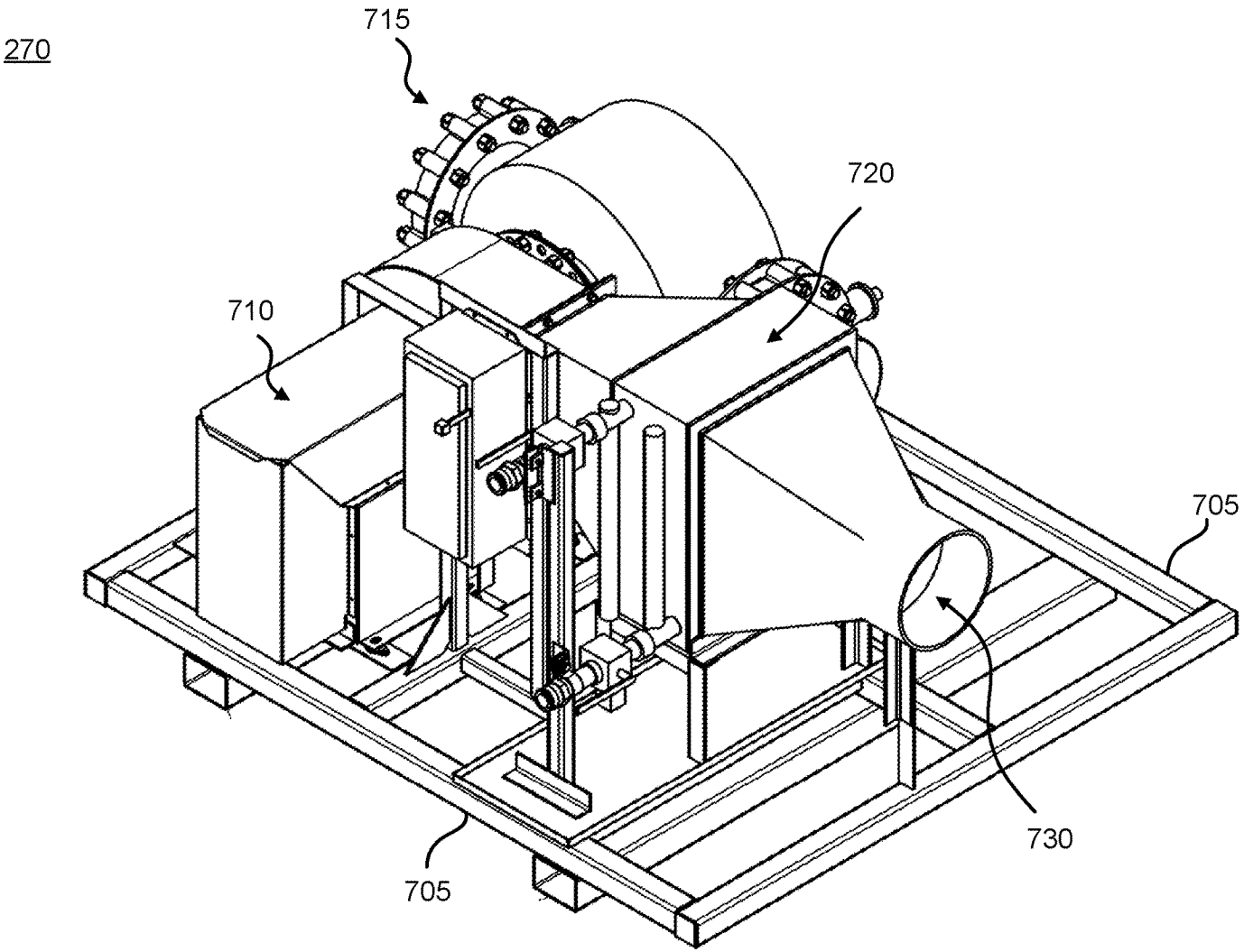
FIG. 7 is a schematic diagram showing an isometric view of a secondary heat exchange assembly, in accordance with one or more embodiments.

FIG. 7 is a schematic diagram showing an isometric view of a secondary heat exchange assembly 270, in accordance with one or more embodiments. The embodiment shown in FIG. 7 is an example of a liquid-to-air heat exchange assembly 270. As shown in FIG. 7, the secondary heat exchange assembly 270 is mounted to the base frame 705. Blower 710 may be operated to intake ambient air via inlet 715 and route the air into heat exchanger 720. The heat exchanger 720 may include heat conducting elements (e.g., heat exchanger coils) that circulate the heated source fluid received from the exhaust heat recovery transport 101. The ambient air may contact the heat conducting elements in the heat exchanger 720 and absorb the thermal energy from the heated source fluid circulating in the heat conducting elements, thereby heating the ambient air. The hot "clean" air may be output from outlet 730 and utilized for different forced hot air applications (e.g., for heating indoor air in a data van).

Example Exhaust Heat Recovery Method

Figure 8:
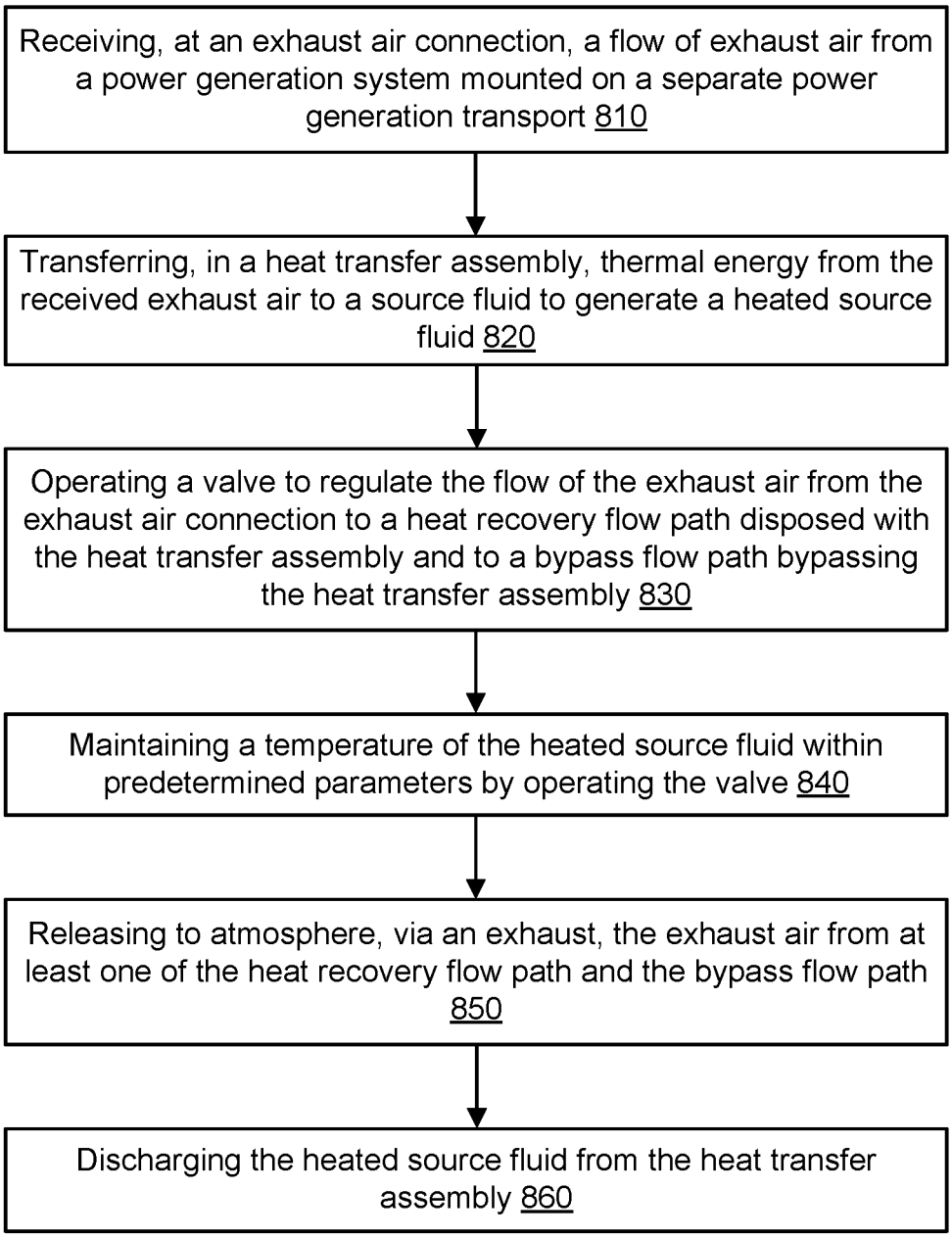
FIG. 8 is a flowchart of an example method for heat transfer, in accordance with one or more embodiments.

FIG. 8 is a flowchart of an example method 800 for heat transfer, in accordance with one or more embodiments. At step 810, the exhaust heat recovery transport 101 receives at an exhaust air connection 210, a flow of exhaust air from a power generation system mounted on a separate power generation transport 102. In some embodiments, the power generation transport 102 may be implemented as a single-trailer power generation transport. In other embodiments, the power generation transport 102 may be implemented using two or more transports, and components of the power generation transport 102 may be arranged on the two or more transports in any reasonable manner. For example, the exhaust air connection 210 may be coupled in an operation mode to an exhaust stack of an inlet and exhaust transport of a two-trailer power generation system to receive a portion of the hot exhaust air that is being released into the atmosphere from the exhaust stack.

At step 820, the exhaust heat recovery transport 101 transfers, in a heat transfer assembly 225, thermal energy from the received exhaust air to a source fluid to generate a heated source fluid.

At step 830, a control system 250 of the exhaust heat recovery transport 101 operates a valve (e.g., control valve 504, valve assembly 240) to regulate a flow of the exhaust air from the exhaust air connection 210 to a heat recovery flow path (e.g., flow path corresponding to duct sections

220A and 220B, valve assembly 240, heat transfer assembly 225, duct section 220C, and exhaust 260) disposed with the heat transfer assembly 225 and to a bypass flow path (e.g., flow path corresponding to duct sections 220A and 220B, bypass duct 235, duct section 220C, and exhaust 260; bypass flow path 525) that bypasses the heat transfer assembly 225. In some embodiments, the control system 250 is powered by the power generation transport 102.

At step 840, the control system 250 of the exhaust heat recovery transport 101 controls to maintain a temperature of the heated source fluid (e.g., source fluid discharged from outlet 232) within predetermined parameters by operating the valve. In some embodiments, the control system 250 operates the valve to release excess exhaust air to atmosphere via the exhaust 260 and the bypass flow path to maintain a temperature of the heated source fluid at a target temperature and within a predetermined tolerance of the target temperature. In some embodiments, the control system 250 utilizes sensor data to maintain the temperature of the heated source fluid at the target temperature. In some embodiments, based on the sensor data, the control system 250 regulates a flow rate of the source fluid through the heat transfer assembly 225 to maintain the temperature of the heated source fluid at the predetermined target temperature.

At step 850, the exhaust heat recovery transport 101 releases to atmosphere, via the exhaust 260, the exhaust air from at least one of the heat recovery flow path and the bypass flow path. In some embodiments, the exhaust heat recovery transport 101 may include multiple exhausts, with one exhaust to release the exhaust air for the heat recovery flow path, and another exhaust to release the exhaust air for the bypass flow path. The exhaust 260 mounted on the exhaust heat recovery transport 101 is separate from the exhaust (e.g., exhaust stack) mounted on, e.g., the inlet and exhaust transport of the power generation system 102.

At step 860, the control system 250 of the exhaust heat recovery transport 101 may control to discharge the heated source fluid from the heat transfer assembly 225. The heated source fluid may then be controlled and released to one or more destinations for downstream heat transfer operations. For example, the heated source fluid may be routed (e.g., by the control manifold 520 controlled by the control system 250) to one or more secondary heat exchange assemblies 270 for generating forced hot air at one or more destinations at the wellsite. As another example, the heated source fluid may be routed to the defrosting package system 290 for use in hot liquid glycol wraps to thaw or heat equipment like tanks, pipes or the wellhead, or heat materials like frac fluid, water, chemicals, etc.

ADDITIONAL CONSIDERATIONS

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). The use of the term "about" means ±10% of the subsequent number, unless otherwise stated.

Use of the term "optionally" with respect to any element of a claim means that the element is required, or alternatively, the element is not required, both alternatives being within the scope of the claim. Use of broader terms such as comprises, includes, and having may be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise.

Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. An exhaust heat recovery apparatus comprising:

a base frame;

an exhaust air connection mounted to the base frame and configured to receive exhaust air from a power generation system;

a heat transfer assembly mounted to the base frame and configured to transfer thermal energy from the exhaust air to a source fluid to generate a heated source fluid;

a valve assembly mounted to the base frame, the valve assembly including a valve configured to regulate a flow of the exhaust air from the exhaust air connection to a heat recovery flow path disposed with the heat transfer assembly and to a bypass flow path bypassing the heat transfer assembly;

a control system mounted to the base frame and configured to operate the valve to regulate the flow of the exhaust air; and an exhaust mounted to the base frame and configured to release to atmosphere the exhaust air from at least one of the heat recovery flow path and the bypass flow path, wherein the exhaust heat recovery apparatus is a mobile unit that is separate from the power generation system.

2. The exhaust heat recovery apparatus of claim 1, wherein the control system operates the valve to maintain a temperature of the heated source fluid within predetermined parameters.

3. The exhaust heat recovery apparatus of claim 1, wherein the control system is further configured to regulate a flow of the source fluid through the heat transfer assembly to maintain a temperature of the heated source fluid within predetermined parameters.

4. The exhaust heat recovery apparatus of claim 1, further comprising a second heat transfer assembly configured to transfer thermal energy from the heated source fluid to a second flow of air to generate a heated air flow, or a separate heated liquid flow.

5. The exhaust heat recovery apparatus of claim 1, wherein the valve assembly further includes an actuator to actuate the valve, wherein the control system and the actuator are powered by the power generation system.

6. The exhaust heat recovery apparatus of claim 1, wherein the control system is further configured to:

determine at least one of a rate of the flow of the exhaust air and a temperature of the exhaust air; and based on the at least one of the rate of the flow of the exhaust air and the temperature of the exhaust air, operate the valve to regulate the flow of the exhaust air to the heat recovery flow path disposed with the heat transfer assembly and release excess exhaust air to atmosphere via the bypass flow path and the exhaust.

7. The exhaust heat recovery apparatus of claim 1, wherein in the heat recovery flow path, the exhaust air from the exhaust air connection flows through the heat transfer assembly and exits the exhaust heat recovery apparatus via the exhaust, and in the bypass flow path, the exhaust air from the exhaust air connection bypasses the heat transfer assembly by flowing through a bypass duct and exits the exhaust heat recovery apparatus via the exhaust.

8. The exhaust heat recovery apparatus of claim 1, wherein the exhaust air connection is detachably coupled to an exhaust stack of the power generation system in an operation mode, and wherein the exhaust heat recovery apparatus is separately and independently movable from the power generation system in a transportation mode.

9. A system for heating source fluid, the system comprising:

a first transport including a power generation system; and a second transport including:

a base frame;

an exhaust air connection mounted to the base frame and configured to receive exhaust air from the power generation system;

a heat transfer assembly mounted to the base frame and configured to transfer thermal energy from the exhaust air to a source fluid to generate a heated source fluid;

a valve assembly mounted to the base frame, the valve assembly including a valve configured to regulate a flow of the exhaust air from the exhaust air connection to a heat recovery flow path disposed with the heat transfer assembly and to a bypass flow path bypassing the heat transfer assembly;

a control system mounted to the base frame and configured to operate the valve to regulate the flow of the exhaust air; and an exhaust mounted to the base frame and configured to release to atmosphere the exhaust air from at least one of the heat recovery flow path and the bypass flow path, wherein the first and second transports are separate transports.

10. The system of claim 9, wherein the first transport includes a gas turbine, an exhaust collector coupled to an exhaust of the gas turbine, and an exhaust stack coupled to the exhaust collector to release exhaust air from the gas turbine to atmosphere.

11. The system of claim 10, wherein the exhaust air connection is detachably coupled to the exhaust stack of the first transport in an operation mode, and wherein the first and second transports are separately and independently movable in a transportation mode.

12. The system of claim 9, further comprising a second heat transfer assembly configured to transfer thermal energy from the heated source fluid to a second flow of air to generate a heated air flow.

13. The system of claim 9, wherein the control system in the second transport is powered by the power generation system of the first transport.

14. The system of claim 9, wherein the control system in the second transport is further configured to:

determine at least one of a rate of the flow of the exhaust air and a temperature of the exhaust air; and based on the at least one of the rate of the flow of the exhaust air and the temperature of the exhaust air, operate the valve to regulate the flow of the exhaust air to the heat recovery flow path disposed with the heat transfer assembly and release excess exhaust air to atmosphere via the bypass flow path and the exhaust.

15. The system of claim 9, wherein the control system operates the valve to maintain a temperature of the heated source fluid within predetermined parameters.

16. The system of claim 9, wherein the control system is further configured to regulate a flow of the source fluid through the heat transfer assembly to maintain a temperature of the heated source fluid within predetermined parameters.

17. A method comprising:

receiving, at an exhaust air connection of an exhaust heat recovery apparatus, a flow of exhaust air from a power generation system mounted on a power generation transport, the exhaust air connection being mounted to a base frame of the exhaust heat recovery apparatus;

transferring, in a heat transfer assembly mounted to the base frame, thermal energy from the received exhaust air to a source fluid to generate a heated source fluid;

operating a valve of a valve assembly mounted to the base frame to regulate the flow of the exhaust air from the exhaust air connection to a heat recovery flow path disposed with the heat transfer assembly and to a bypass flow path bypassing the heat transfer assembly;

maintaining a temperature of the heated source fluid within predetermined parameters by operating the valve;

releasing to atmosphere, via an exhaust mounted to the base frame, the exhaust air from at least one of the heat recovery flow path and the bypass flow path; and discharging the heated source fluid from the heat transfer assembly, wherein the exhaust heat recovery apparatus is a mobile unit that is separate from the power generation system.

18. The method of claim 17, wherein maintaining the temperature of the heated source fluid within the predetermined parameters further comprises maintaining the temperature of the heated source fluid at a predetermined target temperature.

19. The method of claim 17, further comprising:

receiving a flow of the heated source fluid from the heat transfer assembly; and transferring, in a second heat transfer assembly, thermal energy from the received heated source fluid to a second flow of air to generate a heated air flow.

20. The method of claim 17, further comprising receiving power from the power generation system to operate the valve.

* * * * *